US009288589B2

(12) United States Patent
Cheung

(10) Patent No.: US 9,288,589 B2
(45) Date of Patent: Mar. 15, 2016

(54) HEARING AID APPARATUS

(71) Applicant: Yat Yiu Cheung, Hong Kong (HK)

(72) Inventor: Yat Yiu Cheung, Hong Kong (HK)

( * ) Notice: Subject to any disclaimer, the term of this patent is extended or adjusted under 35 U.S.C. 154(b) by 56 days.

(21) Appl. No.: 14/287,204

(22) Filed: May 27, 2014

(65) Prior Publication Data

US 2014/0270290 A1 Sep. 18, 2014

Related U.S. Application Data

(63) Continuation-in-part of application No. 13/227,451, filed on Sep. 7, 2011, now abandoned, and a continuation-in-part of application No. 12/127,839, filed on May 28, 2008, now abandoned.

(51) Int. Cl.
*H04R 25/00* (2006.01)

(52) U.S. Cl.
CPC ..... *H04R 25/554* (2013.01); *H04R 25/405* (2013.01); *H04R 25/552* (2013.01); *H04R 25/407* (2013.01); *H04R 25/604* (2013.01); *H04R 2420/07* (2013.01)

(58) Field of Classification Search
CPC ..... H04R 25/00; H04R 25/55; H04R 25/558; H04R 2225/49; H04R 2460/01
USPC ..... 381/312–313, 315–317
See application file for complete search history.

(56) References Cited

U.S. PATENT DOCUMENTS 4,712,244 A * 12/1987 Zwicker ..... H04R 25/407 381/313
5,483,599 A * 1/1996 Zagorski ..... H04M 1/19 381/313
5,715,319 A * 2/1998 Chu ..... H04R 3/005 381/313
5,793,875 A * 8/1998 Lehr ..... H04R 25/554 381/313
6,421,448 B1 * 7/2002 Arndt ..... H04R 25/407 381/313
6,539,096 B1 * 3/2003 Sigwanz ..... H04R 25/407 381/313

* cited by examiner

*Primary Examiner* — Suhan Ni

(57) ABSTRACT

The present application is directed to a hearing aid apparatus for wearing use by a user, including a frontend sound collector configured to collect a frontend signal; a backend sound collector configured to collect a backend signal; and a sound processor configured to process the frontend signal and the backend signal; wherein the sound processor includes a frontend delayer configured to apply a delay coefficient to the frontend signal to produce a delayed frontend signal; a backend delayer configured to apply the delay coefficient to the backend signal to produce a delayed backend signal; and an adaptive filter configured to process the delayed frontend signal and the delayed backend signal to produce an adaptive filter output signal.

18 Claims, 24 Drawing Sheets

HEARING AID APPARATUS

CROSS REFERENCE TO RELATED PATENT APPLICATION

This is a continuation-in-part application of U.S. patent application Ser. No. 13/227,451 filed on Sep. 7, 2011, which is a continuation-in-part application of U.S. patent application Ser. No. 12/127,839 filed on May 28, 2008, the entire content of which is hereby incorporated by reference.

BACKGROUND

Hearing aid apparatus are useful for people with impaired hearing. A typical hearing aid comprises an ear piece mounted with a microphone for collecting ambient sound and an amplifier for amplifying the collected sound. However, the sound quality of conventional hearing aid apparatus is not satisfactory.

Various sound quality enhancing techniques have been proposed to enhance sound quality of hearing aid apparatus.

For example, WO 97/40645 discloses a directional acoustic receiving system in the form of a necklace and including an array of microphones mounted on a housing supported on the chest of a user. Such a system requires a division of audio frequency by the microphones and the quality of sound is still unsatisfactory.

WO 2007/052185 discloses a hearing aid system in which a plurality of sound detectors is mounted on the side and front portion of an eye-glass frame. Such a system is so heavy, bulky and complicated that the product is not available to the public.

HK1101028A by the same inventor discloses a hearing aid apparatus comprising a pair of ear mounted parts. Each ear mount part comprises a housing having a curved portion for attaching to the rear curved part of a user's ear. A microphone is mounted at the bottom end of the housing and the sound collected by the pair of microphones is processed by an external signal processor using beamforming techniques. However, the apparatus is relatively bulky, the sound quality is not satisfactory and the pair of parts must be worn at the same time in order to work as designed.

Therefore, it would be advantageous if improved hearing aid apparatus can be provided.

SUMMARY

Accordingly, there is provided a hearing aid frontend device for frontend processing of ambient sounds. The frontend device is adapted for wearing use by a user and comprises first and second sound collectors adapted for collecting ambient sound with spatial diversity. The sounds collected by the sound collectors are processed by a sound processor. The sound process comprises a digital signal processor for beamforming sounds collected by the first and second collectors, and the processed sounds are subsequently subject to adaptive noise cancellation. To achieve spatial diversity and to facilitate spatial selectivity, the first and second sound collectors are arranged such that the transverse separation distance between the sound collectors during use is greater than the face width of a user. In general, the sound processor is adapted to process the ambient sounds collected by the first and second sound collectors and select sounds forward of the user for subsequent noise cancellation and output to the user.

BRIEF DESCRIPTION OF THE DRAWINGS

Exemplary hearing aid arrangements will be described below by way of example with reference to the accompanying Figures in which:—

DETAILED DESCRIPTION OF EXEMPLARY EMBODIMENTS

Figure 1:
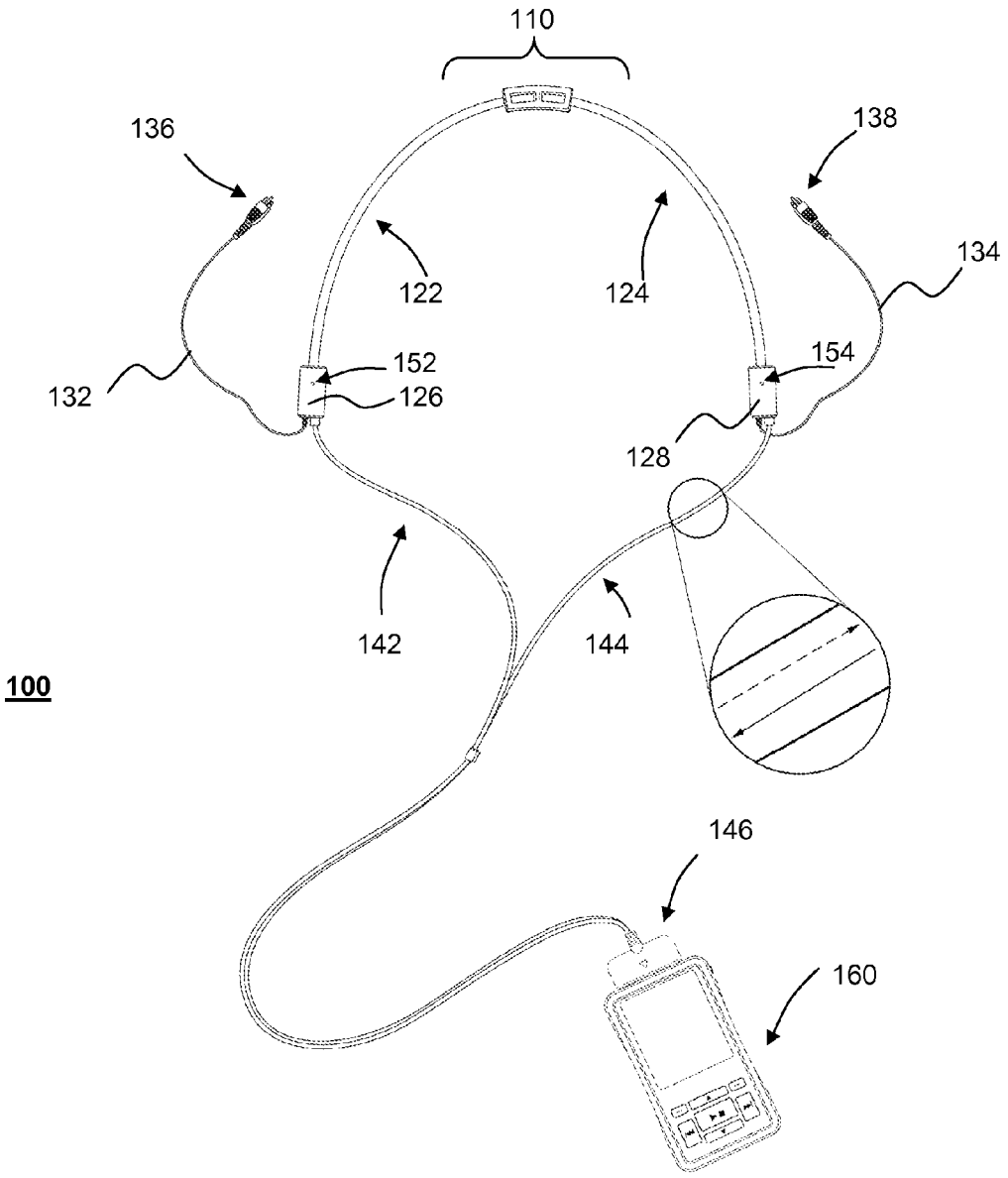
FIG. 1 is a front view of a first example hearing aid frontend.
Figure 2:
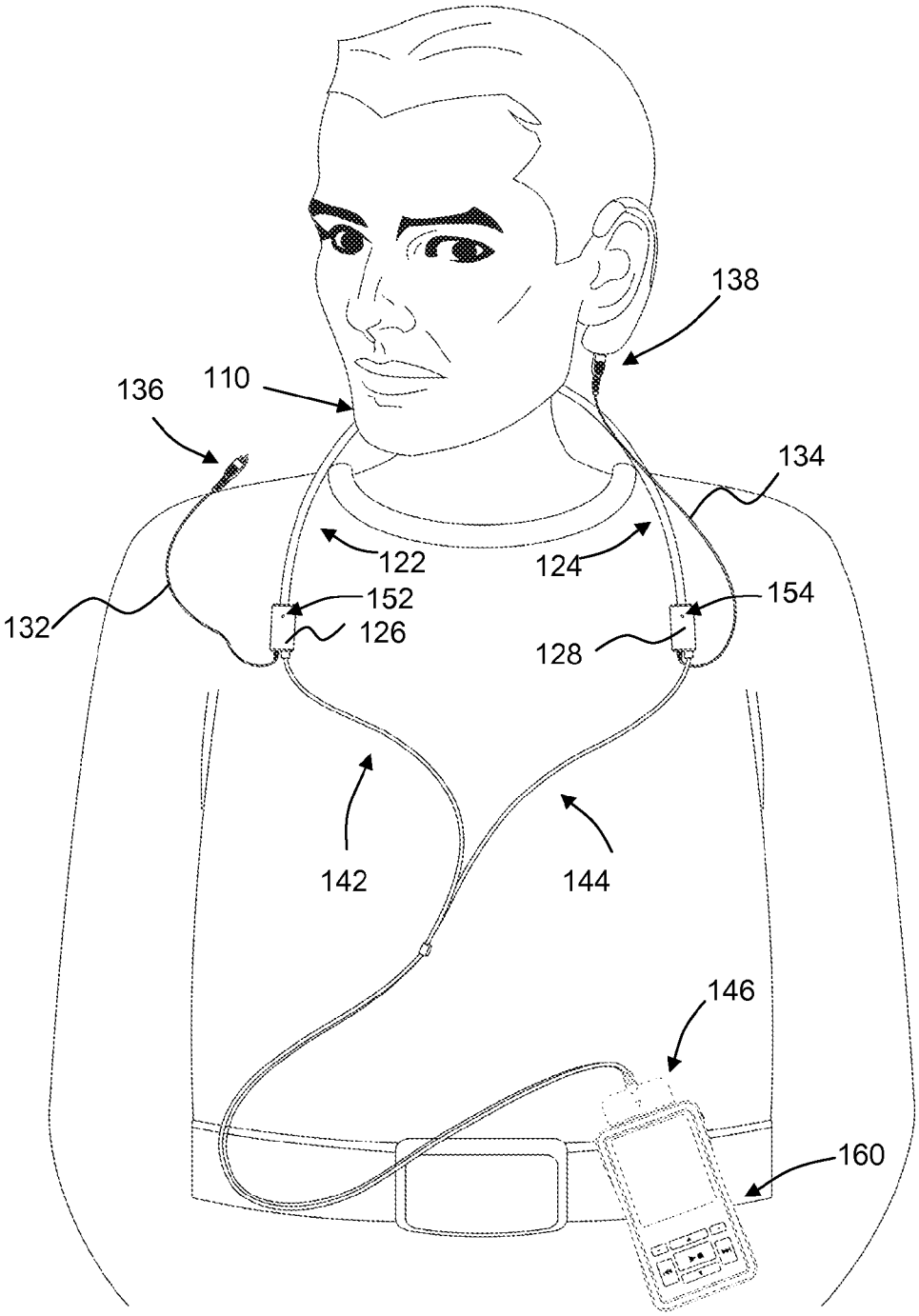
FIG. 2 is a schematic view depicting the frontend of FIG. 1 when worn by a user and in use.

The hearing aid frontend 100 of FIGS. 1 and 2 comprises a neck-mount portion 110 having a curved body comprising first and second curved arms 122,124, a pair of microphone casings 126,128 mounted at the extreme ends of the curved body inside each of which a microphone is mounted, first and second flexible cable portions 132, 134 each extending between a microphone casing and an audio signal output terminal 136, 138, second flexible cable portions 142, 144 each extending between the microphone casing and a signal connector 146, and a signal processing device 160.

The neck-mount portion 110 is adapted for wearing by a user around the back portion of the neck. The first and second curved arms 122, 124 are rigid or semi-rigid so that the separation between the extreme free ends is substantially constant. In addition, the curved body is shaped and configured such that when the curved body is worn by a user, the extreme free ends are forward of the neck of the user at substantially the same vertical level and with a transverse separation larger than the face width of the user. As shown in FIG. 2, microphone casings, which are mounted at the extreme free ends of the curved body, are hanging on the front chest portion of the user proximal the collar bone. The separation of the microphones is set to be between 15 cm to 18 cm for optimal sound output quality.

Figure 3:
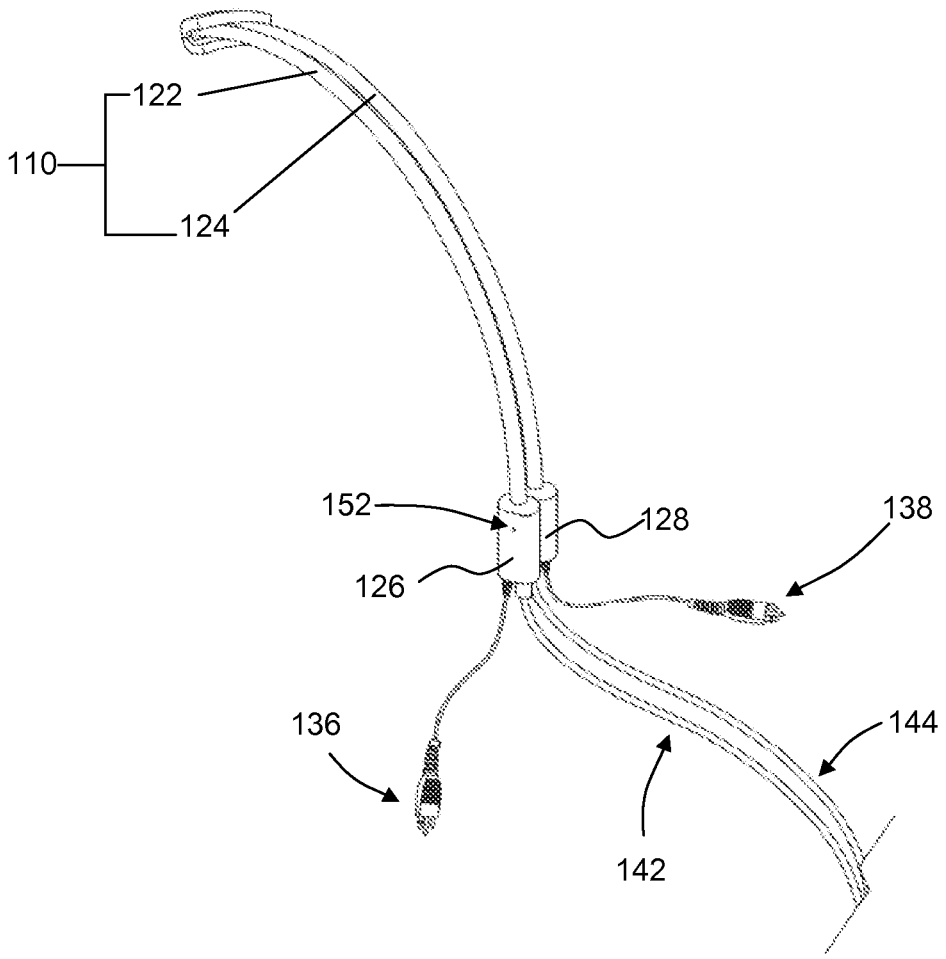
FIG. 3 illustrates the hearing aid frontend of FIG. 1 in a folded configuration.
Figure 3A:
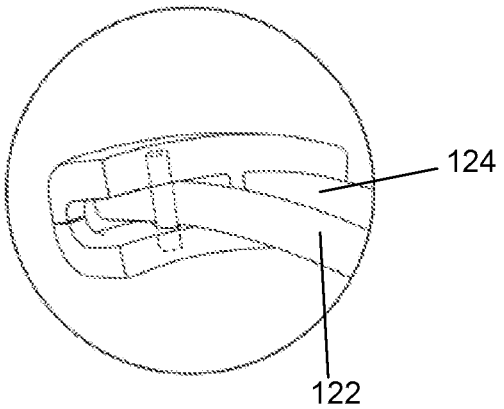
FIG. 3A is an enlarged view of a portion of FIG. 3.

The curved body is foldable about its central axis and about a live joint intermediate the curved arms. The curved body is configured into that shown in FIGS. 3 and 3A when the curved arms are folded, thereby facilitating enhanced portability and storage.

A condenser microphone as an example of a sound collector is mounted inside a moulded plastic casing. An aperture 152, 154 defining an aperture axis which is substantially orthogonal to a plane defined by the pair of curved arms is disposed forward of the user. When the curved body is worn on a user during normal use, the microphone casings are such that the apertures are forward facing with each aperture axis defining a forward direction for reference. More specifically, each microphone is mounted inside a microphone casing with the sound receiving surface of the microphone in forward communication with the aperture. In other words, the sound receiving portion of the microphone is immediately behind the aperture for efficient sound collection.

Ambient sounds collected by the microphones, in the form of electrical signals, are transmitted to the sound processor 160 by flexible cable portions 142, 144. Each flexible signal portion comprises a two-way signal path—a first path for transmitting collected signals to the sound processor for processing and a second path for transmitting audio signal output from the sound processor 160 to the user via the signal output terminals 136, 138.

Figure 12:
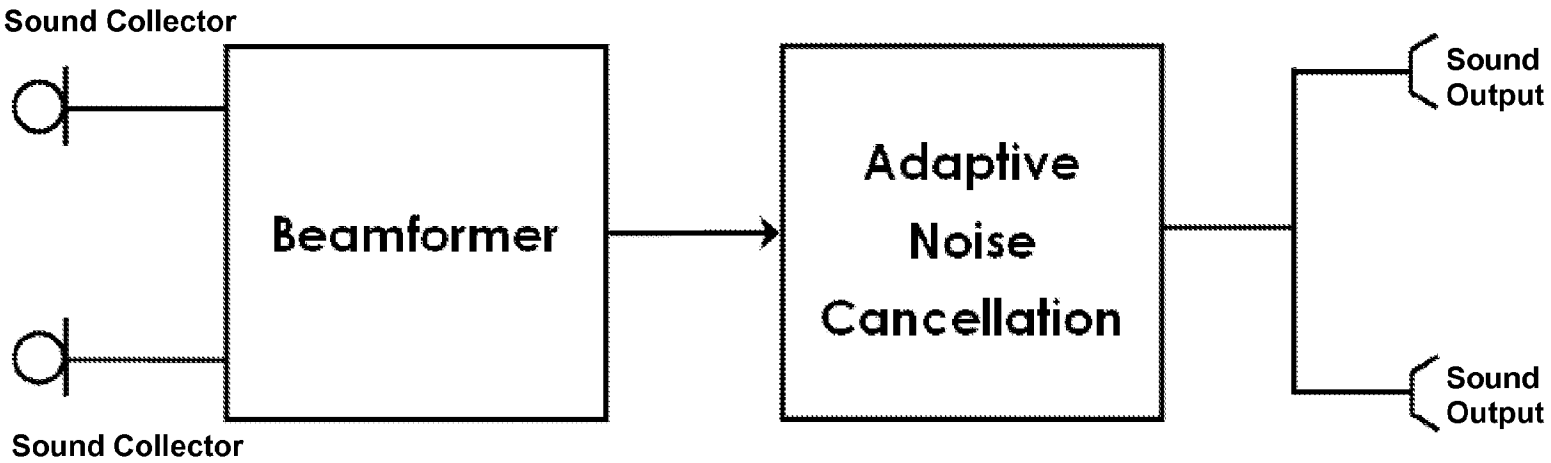
FIG. 12 shows block diagrams illustrating exemplary signal processing arrangements of the exemplary hearing aid frontends.

The sounds collected by the microphones are transmitted to the signal processing portion of the sound processor for sound quality enhancement processing. More specifically, the sound processor 160 is adapted to process sound collected by the spaced apart microphones using beamforming techniques to achieve spatial selectivity, and then to further process the signals after beamforming processing with noise cancellation techniques to further enhance sound quality as shown in FIG. 12.

Beamforming is a signal processing technique used in sensor arrays for directional signal transmission or reception to achieve spatial selectivity. This is achieved by combining signals coming from spaced-apart sensor elements in the array in such a way that signals at particular angle experience constructive interference and while others experience destructive interference. Beamforming technique is used at the receiver side to achieve spatial selectivity in hearing aid applications.

In the exemplary applications, the spaced apart microphones are deployed as an array of sound detectors for providing a source of signal diversity for beamforming, thereby achieving spatial selectivity. Specifically, beamforming techniques are used to improve sound reception quality by selecting sound coming from the forward direction and filtering off spurious sounds coming from the lateral side of the user. As a convenient example, the forward direction is set to be at ±30° with respect to the forward axis of a user. The forward axis is defined herein as an axis orthogonal to the body central axis and extending forward of a user.

To provide an appropriate spatial diversity for beamforming audio signals, the microphones are separated at a distance of between 15 cm-18 cm. Such a separation distance has been shown to produce an enhanced Signal-to-Interference Ratio (SIR) compared to conventional hearing aid apparatus.

Figure 13:
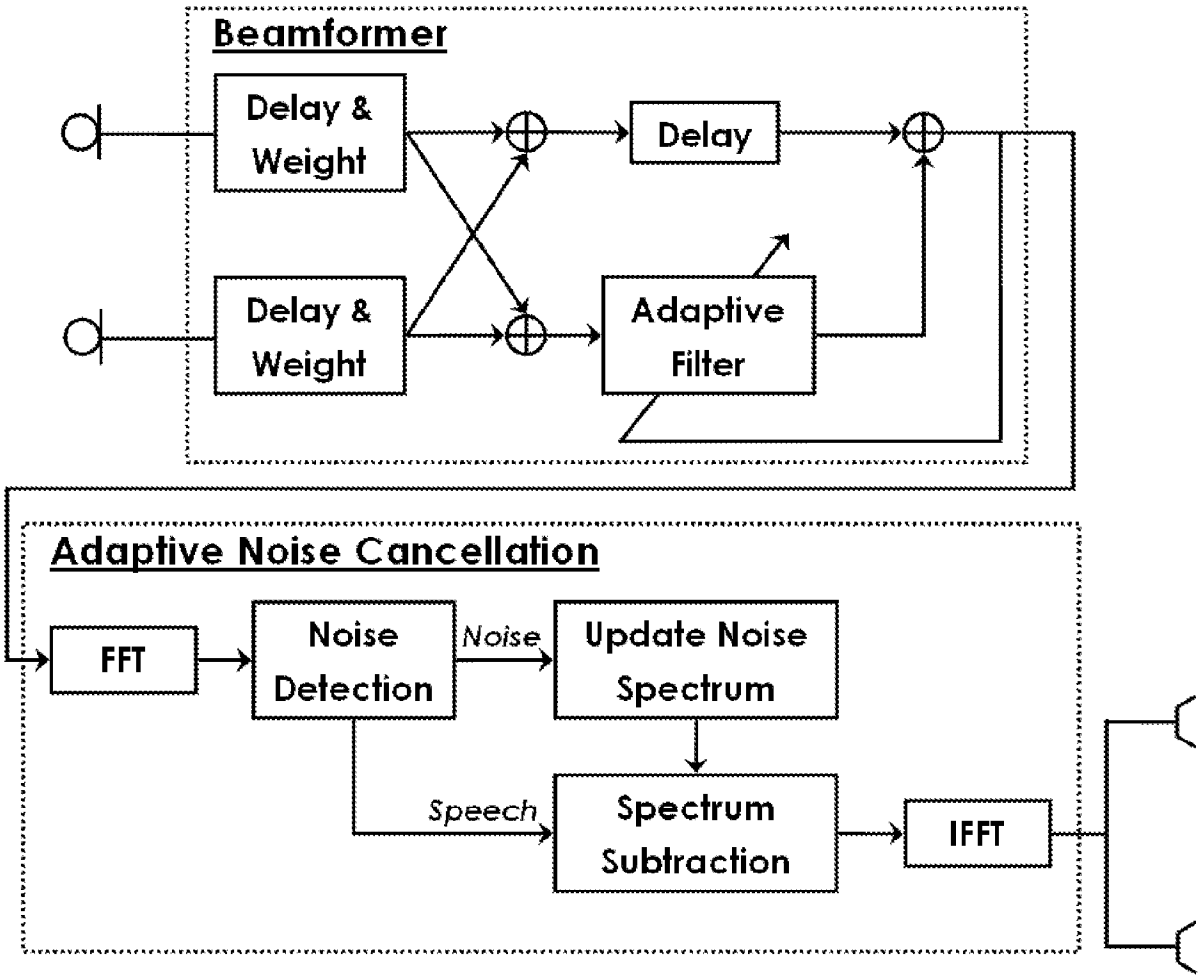
FIG. 13 shows exemplary signal processing arrangements of the exemplary hearing aid frontends with more specific details.

In an example as depicted in the block diagrams of FIG. 13, the signal processing portion of the sound processor is adapted to apply a technique of fixed beamforming using generalized sidelobe cancellation (GSC) to process the signals received from the two microphones. In the first stage of GSC, the delay-and-sum beamforming algorithm is applied to the two signals received from the two microphones to suppress interference and to approximate a desired signal of the listening sound. In the second stage of GSC, a reference interfering signal is approximated by the delay-and-subtract version of the signals received from the two microphones. Least Mean Squared (LMS) adaptation algorithm is then applied to the delay-and-sum beamformed signal obtained from the first stage as the input noisy signal and the delay-and-subtract signal as the reference interference to further improve the SIR. An Adaptive Noise Cancellation (ANC) algorithm is then applied to suppress background noise to obtain a better signal-to-noise ratio (SNR), so that the sound appearing at the ear of a user is more distinguishable. The output of the sound processor 160 is then transmitted to the signal output terminals for transmission to an ear piece as depicted in FIG. 2.

Figure 14:
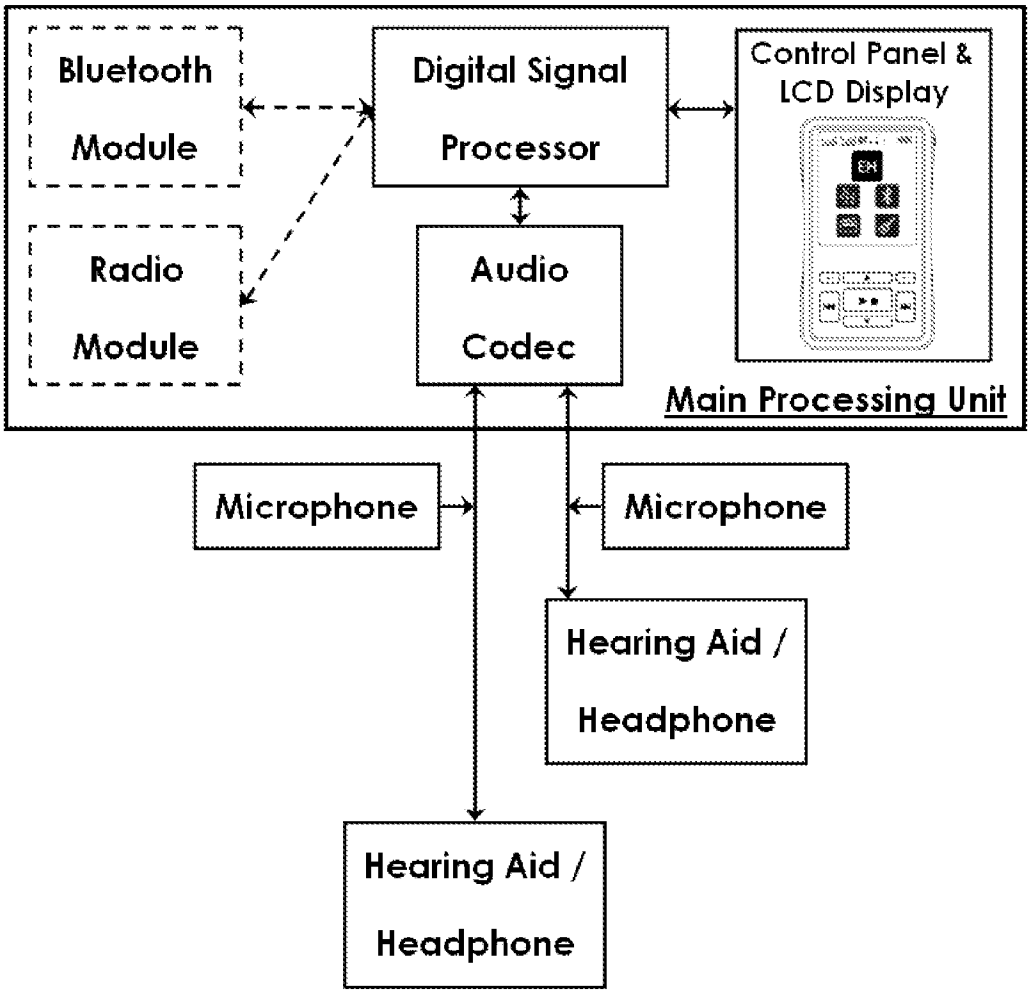
FIG. 14 shows block diagrams of an exemplary hearing aid apparatus incorporating the signal processing arrangement of FIGS. 12 and 13.

In addition to the signal processing portion which comprises beamforming and noise cancellation portions, the sound processor unit further comprises an audio codec (coder-decoder) portion for converting input analog signal to digital signal and processed digital signal to analog signal for output, as shown in FIG. 14. The received signals are transmitted from the audio codec and then forwarded to a digital signal processor for beamforming and noise cancellation processing.

Figure 15:
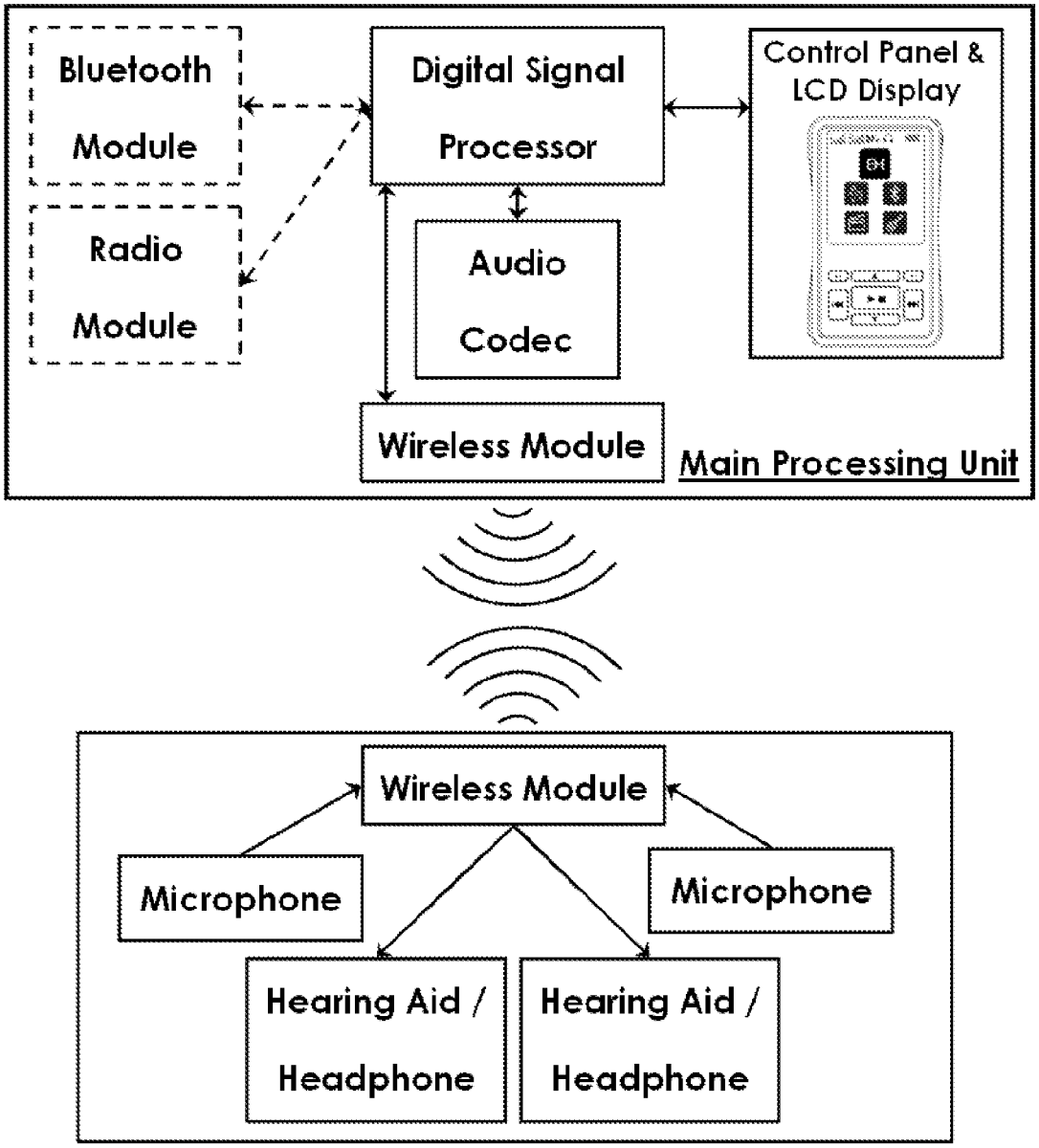
FIG. 15 shows another exemplary hearing apparatus incorporating the signal processing arrangement of FIGS. 12 and 13.

In another example as depicted in FIG. 15, the sound processor is equipped with a bluetooth module as an example of a wireless transceiver to eliminate the need of the flexible cable portions 142 and 144 or their corresponding equivalents.

In use, a user wears the hearing aid frontend 100 in the manner as depicted in FIG. 2, with the microphone apertures forward facing and the signal output terminal 138 connected with an ear piece. After switching on the sound processor, the sound processor will process the sounds collected by the two microphones and then transmit the processed sound to the ear piece.

Figure 4:
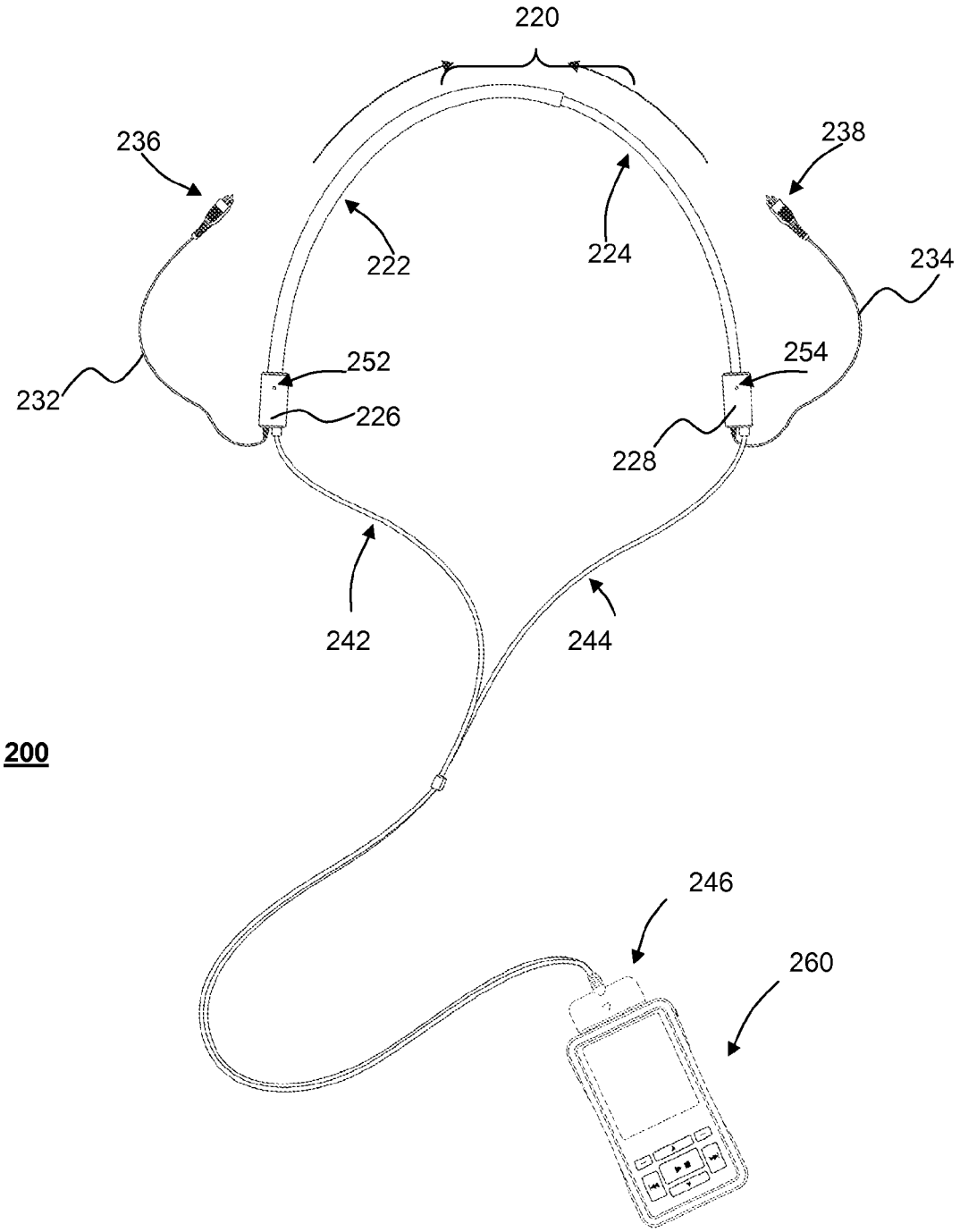
FIG. 4 is a perspective view showing a second example hearing aid frontend.

FIG. 4 depicts a second example hearing aid frontend 200, this hearing aid frontend is substantially identical to that of FIG. 1, except that the curved body 220 is arranged such that the second arm is retractable into the first arm. This retractable arm arrangement is advantageous because the transverse separation of the microphones is user adjustable by varying the degree of arm retraction, and the curved body can be collapsed for storage and carriage. As the features of this frontend are substantially identical to that of the first one, descriptions in relation to the first example frontend are incorporated herein by reference with the numerals added by 100.

Figure 5:
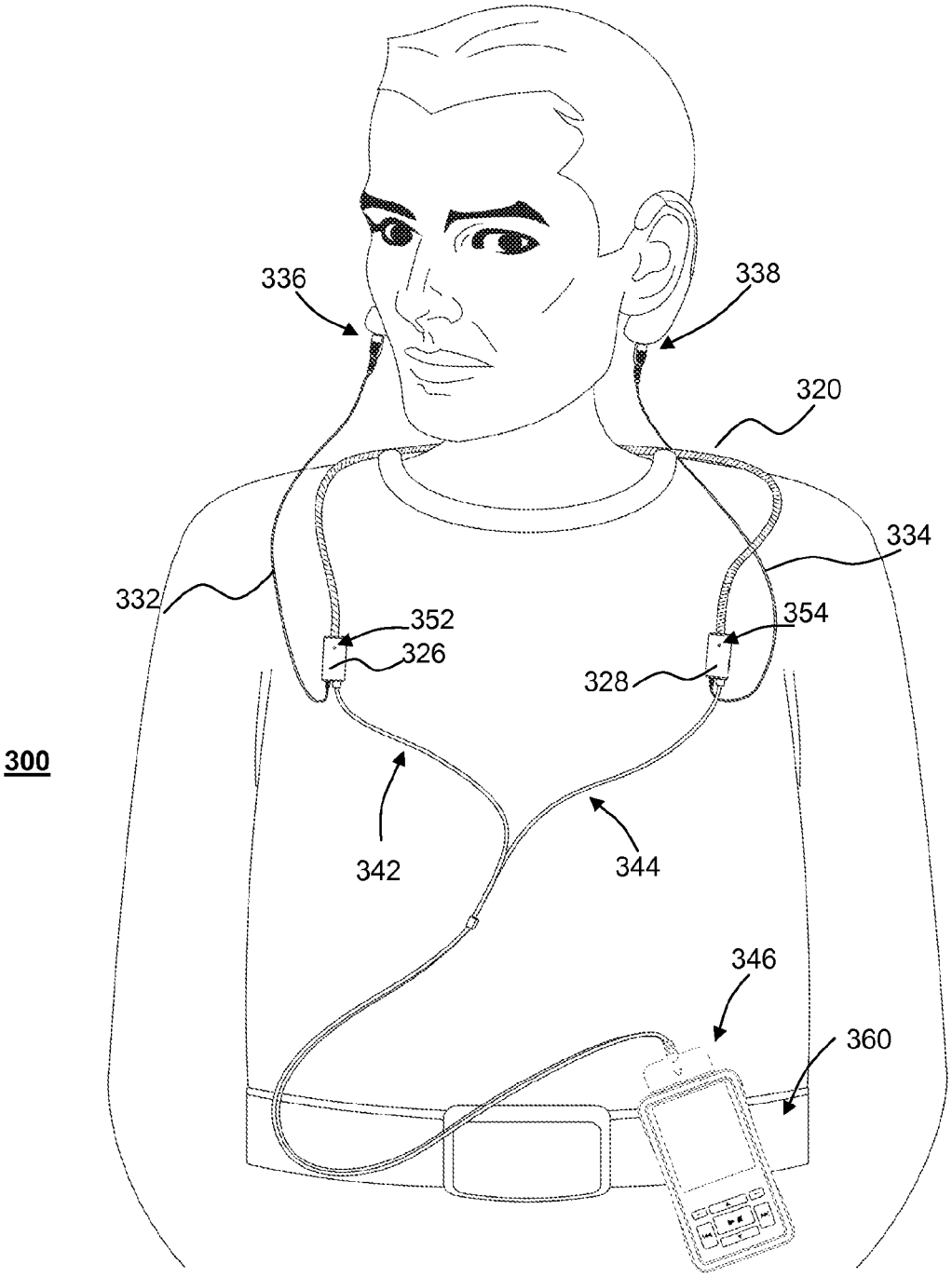
FIG. 5 is a schematic diagram depicting a third example hearing aid frontend when worn by a user and in use.

FIG. 5 depicts a third example hearing aid frontend 300, this hearing aid frontend is substantially identical to that of FIG. 1, except that the curved body is replaced by a flexible body 320 of irregular shape such that the separation of the microphone casings is user adjustable. The flexible body means that a good portion of the frontend can be hidden under clothes. As the features of this frontend are substantially identical to that of the first one, descriptions in relation to the first example frontend are incorporated herein by reference with the numerals added by 200.

Figure 6:
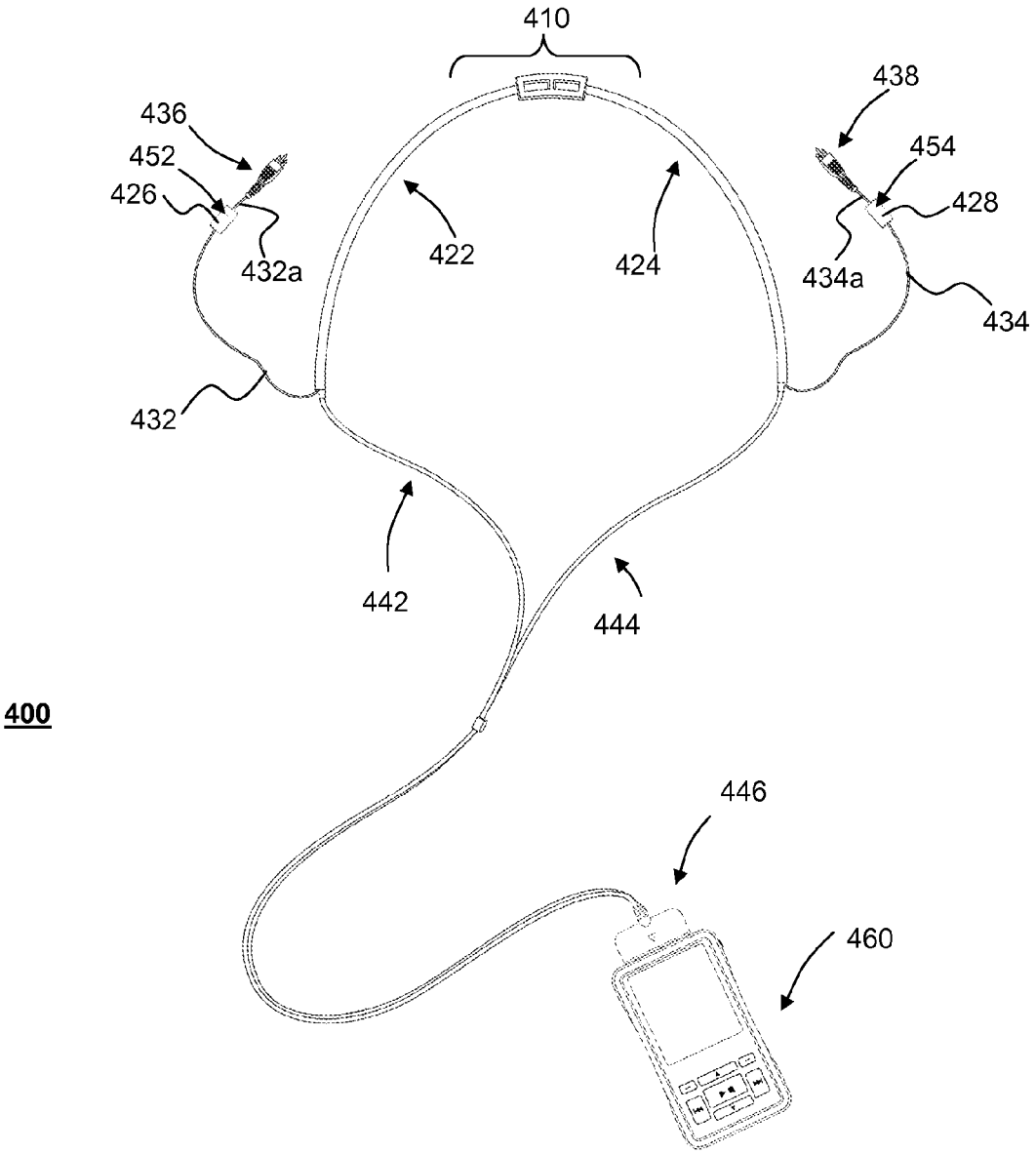
FIG. 6 is a schematic diagram depicting a fourth example hearing aid frontend.

FIG. 6 depicts a fourth example hearing aid frontend 400, this hearing aid frontend is substantially identical to that of FIG. 1, except that the microphone housings are not mounted on the rigid or semi-rigid curved body. Instead, the microphone casings are mounted on the first and second flexible cable portions 432, 434 and at locations between the signal output terminal 436, 438 and the corresponding ends of the curved body. The distance between the microphone casing and a corresponding signal output terminal is adapted such that the microphone casings are proximal the neck portion of a user during use. The flexible mounting also facilitates user adjustable microphone separation. As the features of this frontend are substantially identical to that of the first example, descriptions in relation to the first example frontend are incorporated herein by reference with the numerals added by 300.

Figure 7:
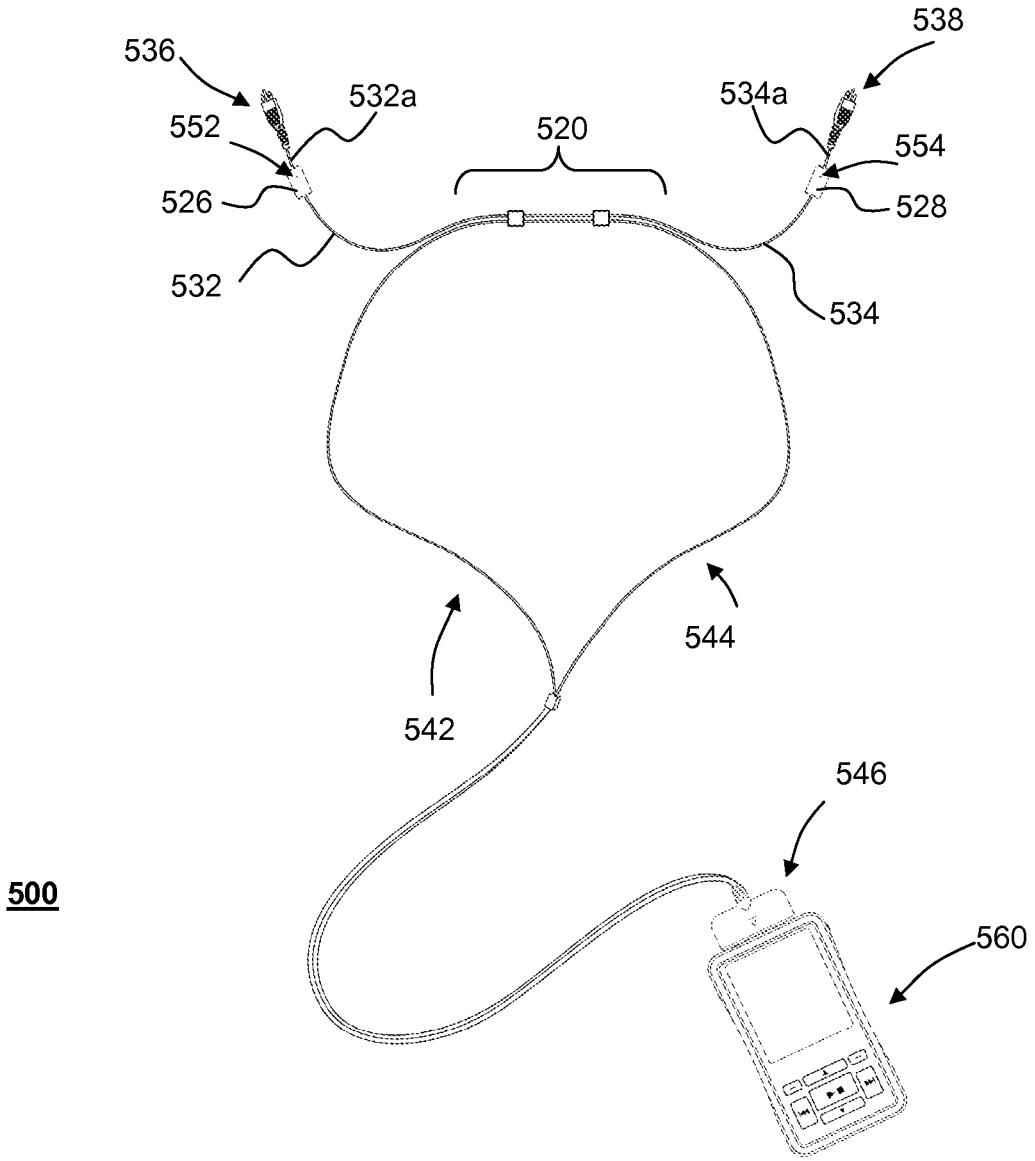
FIG. 7 is a schematic diagram depicting a fifth example illustrating a hearing aid apparatus.

FIG. 7 depicts a fifth example hearing aid frontend 500, this hearing aid frontend is substantially identical to that of FIG. 6, except that the rigid or semi-rigid curved body is replaced by a flexible cable portion. This flexible cable portion 520 is formed by grouping overlapping portions of the first and second cable portions 532, 534. The grouped overlapping portions are bound together by a pair of stops such that the length of the overlapped portions can be changed by varying the location of the stops. It will be noted that the separation distance between the microphone casings could be changed by a user by relatively moving the stops. Likewise, the loop size defined by the overlapped cable portion and the flexible cable portion are adjustable by the moveable stops. As features of this frontend are substantially identical to that of the fourth example, descriptions in relation to the fourth example frontend are incorporated herein by reference with the numerals added by 100.

Figure 11:
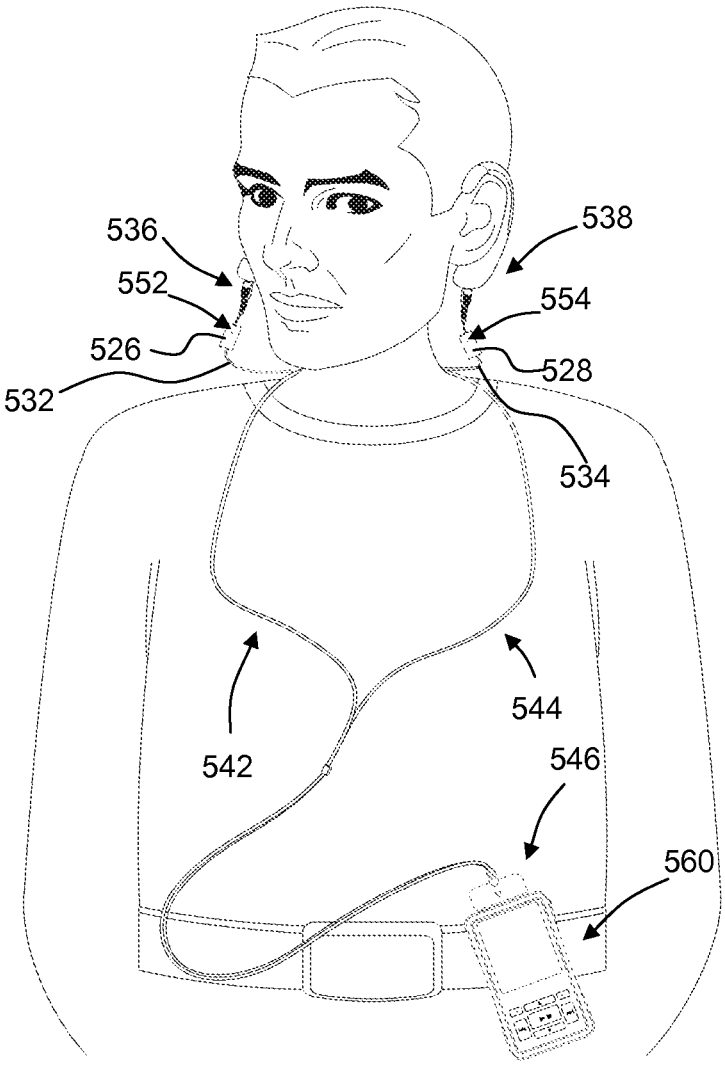
FIG. 11 is a schematic diagram depicting the hearing aid frontend of FIG. 7 in use.

In use, a user wears the frontend with the flexible cable loop around a user's neck as shown in FIG. 11 in a manner such that the flexible cable portion 520 rests against the back of the neck and each microphone casing is forward facing and intermediate the user's ear and shoulder.

Figure 8:
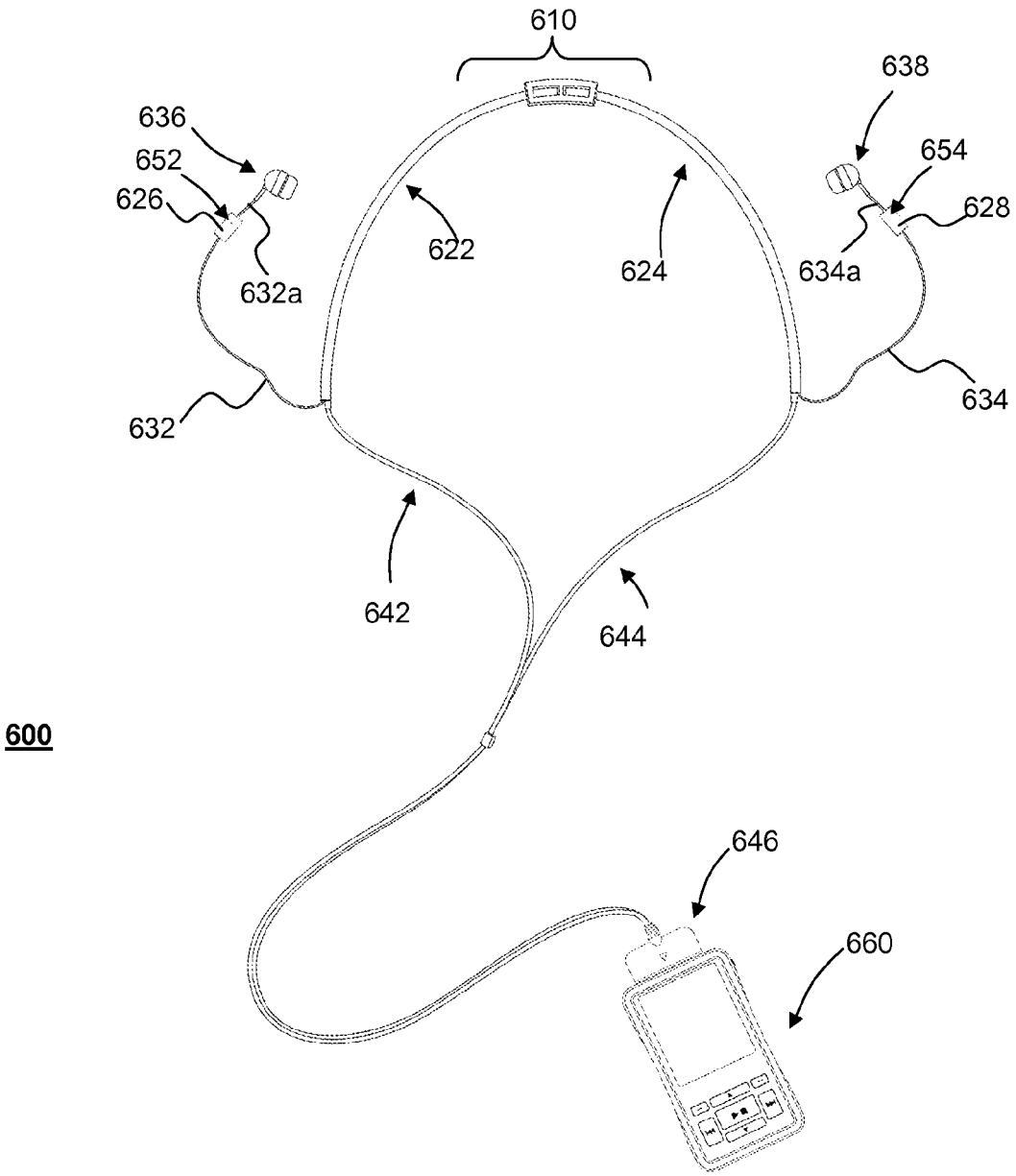
FIG. 8 is a schematic diagram depicting a sixth example illustrating another hearing aid apparatus.

The hearing aid apparatus of FIG. 8 depicts a sixth example hearing aid frontend 600 connected with ear phones, this hearing aid frontend is substantially identical to that of FIG. 6, except that the signal output terminals are replaced with ear phones 636, 638 to form a complete hearing aid apparatus. As the features of this frontend are substantially identical to that of the fourth example, descriptions in relation to the fourth example frontend are incorporated herein by reference with the numerals added by 200.

Figure 9:
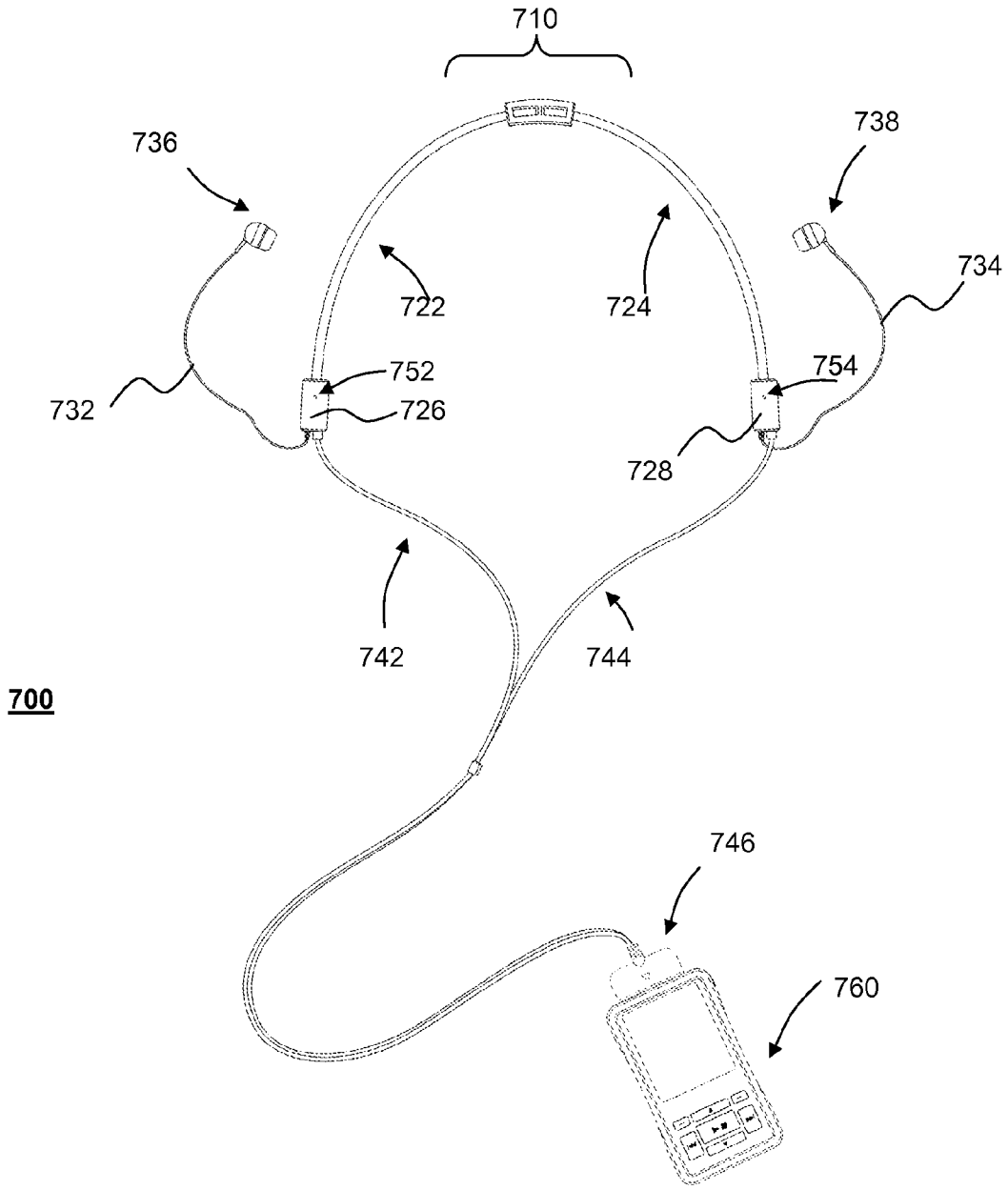
FIG. 9 is a schematic diagram depicting a seventh example illustrating another hearing aid apparatus.

The hearing aid apparatus of FIG. 9 depicts a seventh example hearing aid frontend 700 connected with ear phones, this hearing aid frontend is substantially identical to that of FIG. 6, except that the microphone casings 726,728 are mounted at extreme ends of the curved body. As the features of this frontend are substantially identical to that of the fourth example, descriptions in relation to the sixth example frontend are incorporated herein by reference with the numerals added by 100.

Figure 10:
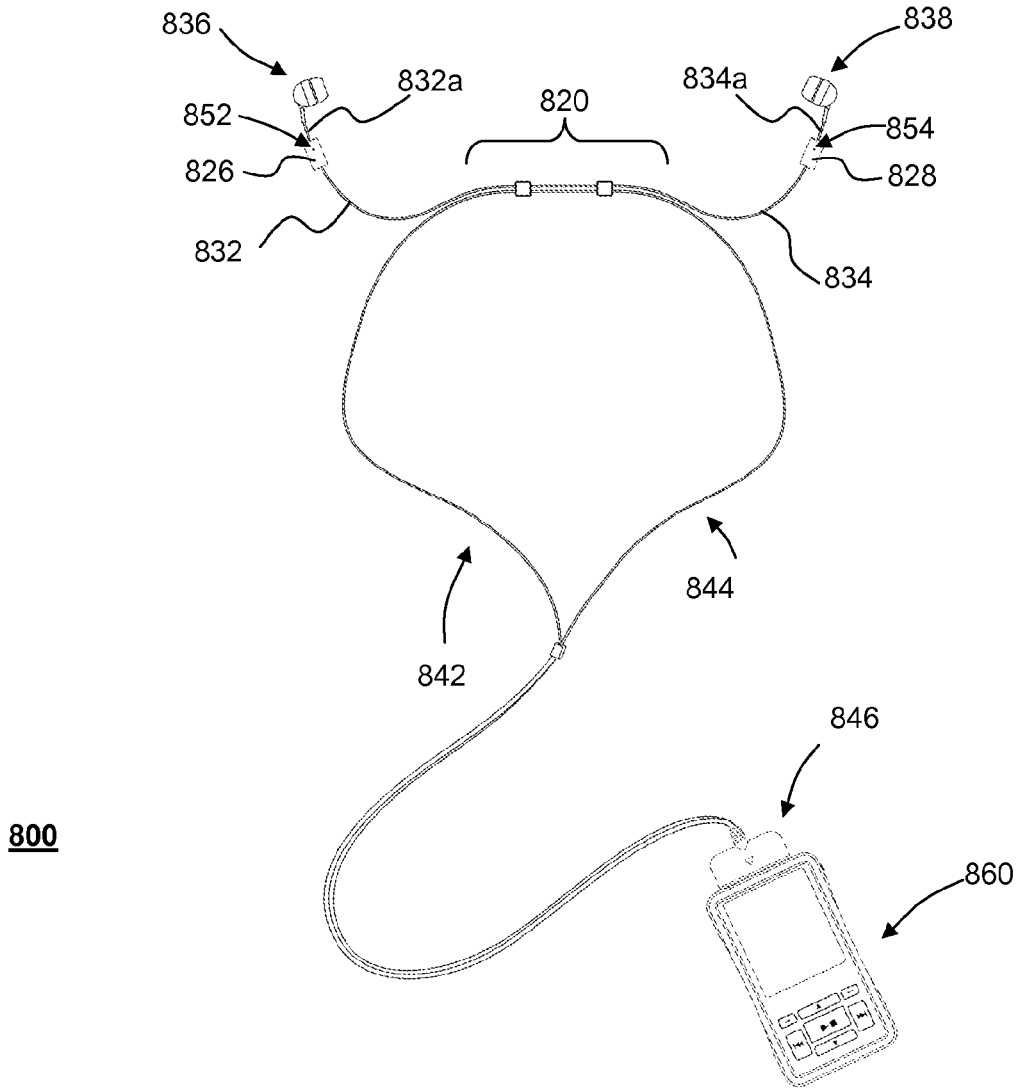
FIG. 10 is a schematic diagram depicting an eight example illustrating yet another hearing aid apparatus.

The hearing aid apparatus of FIG. 10 depicts an eighth example hearing aid frontend 800 connected with ear phones, this hearing aid frontend is substantially identical to that of FIG. 8, except that the curved body is replaced by the overlapping flexible cable portion of the example of FIG. 7. As the features of this frontend are substantially identical to that of the fifth and sixth examples, descriptions in relation to the sixth example frontend are incorporated herein by reference with the numerals added by 300 and 200 respectively where appropriate.

As most features are common to the various examples, appropriate numerals are impliedly incorporated into the individual figures with reference to the example number without loss of generality. Furthermore, as a common sound processor 160 can be used with the various examples, the sound processor is marked with the same numeral throughout without loss of generality.

In the examples of FIGS. 1-5 and 9, there is provided an audio signal output terminal associated with each microphone casing. More specifically, there is a length of flexible cable portion connecting a signal output (including an ear piece) with a corresponding microphone casing. As each audio signal output terminal received audio signal output from the sound processor 160, this arrangement provides useful choice to a user since the user may elect to use either one or both of the signal outputs for increased flexibility.

In the examples of FIGS. 6 to 9, there is provided an audio signal output terminal associated with each microphone casing. More specifically, there is a length of flexible cable portion connecting a signal output (including an ear piece) with a corresponding microphone casing. In those examples, the positions of the microphone casings (and hence the sound collectors) are substantially predetermined by the length of the flexible cable portion, although a small extent of variation is possible because the transverse separations of the microphone housings are user adjustable, and the adjustment is pivotally about a corresponding output terminal due to the flexible linkage.

While various examples of hearing aid frontends and apparatus have been described above with reference to the Figures, it will be appreciated that the examples are non-limiting and are only provided for reference to persons skilled in the art who would of course understand that various modifications could be made within the scope of disclosure without loss of generality. For example, while a fixed beamforming technique is used for exemplary frontend signal process, other beamforming techniques can be used without loss of generality.

Figure 16:
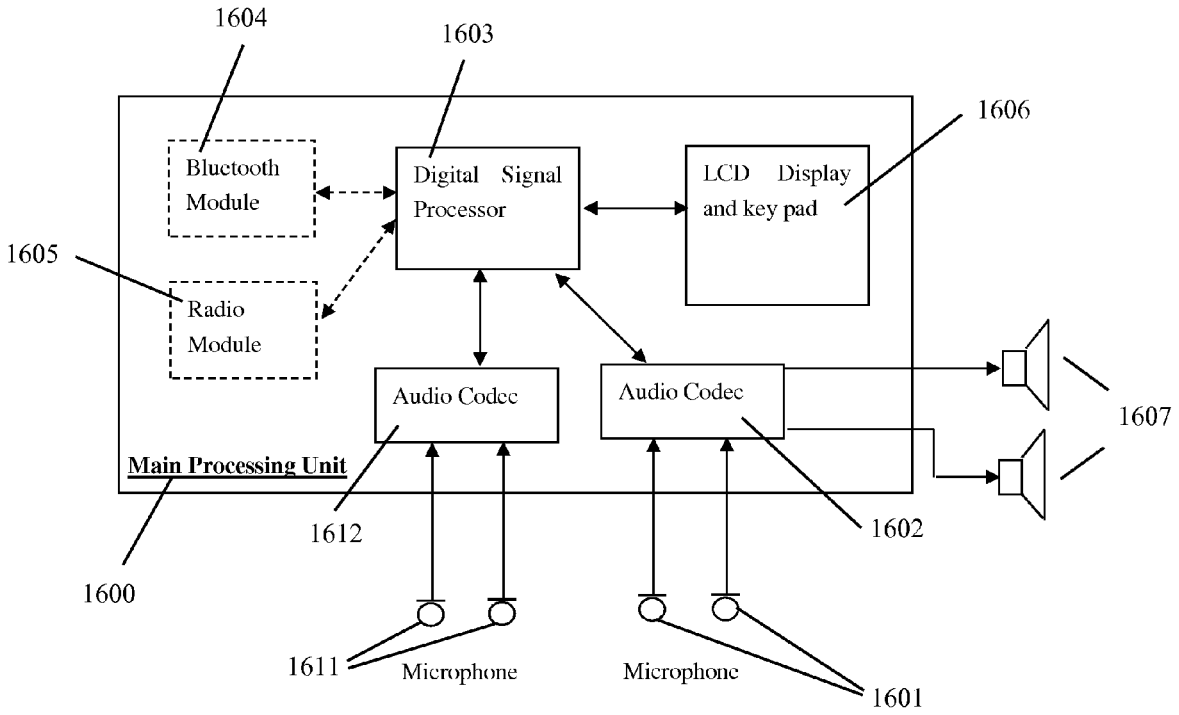
FIG. 16 shows another exemplary hearing aid apparatus with frontend and backend microphones.

According to another embodiment of the present application, a hearing aid apparatus shown in FIG. 16 includes at least one frontend microphone 1601 and at least one backend microphone 1611 for conversion of sound signals arriving at the microphones 1601 and 1611 into microphone audio signals representing sound. As an example, the hearing aid apparatus may have two frontend microphones 1601 for sound collection which physically locate in front direction and two backend microphones 1611 for collecting the noise which physically locate in back direction.

Analog audio signals output by microphones 1601 and 1611 are fed to audio CODECs (coder-decoder) 1602 and 1612 respectively where the analog data are digitalized. The digital data are then output to a Digital Signal Processor (DSP) 1603 for processing. The two frontend microphones 1601 connect the CODEC 1602 while the two backend microphones 1611 connect the CODEC 1612.

The hearing aid apparatus may be equipped with wireless transceivers, for example, a Bluetooth module 1604 and a Radio module 1605 illustrated in FIG. 16. The hearing aid apparatus also includes a LCD display and key pad 1606 for displaying preset information and receiving a user's input. The audio CODECs 1602 and 1612, the Digital Signal Processor (DSP) 1603, the Bluetooth module 1604, the Radio module 1605, and the LCD display and key pad 1606, may be included in a main processing unit 1600. As an example, the audio CODEC 1602 can also be used to process digital data from the Digital Signal Processor (DSP) 1603 to analog data and then output the analog data to sound output terminals 1607.

The hearing aid apparatus may include various modes. A user can choose different modes in different situations in this system, for example, via a control key disposed on the key pad 1606. The system output performance corresponding to different calculations and settings will be described in detail below.

1) NC Mode (Default Mode)

Figure 17:
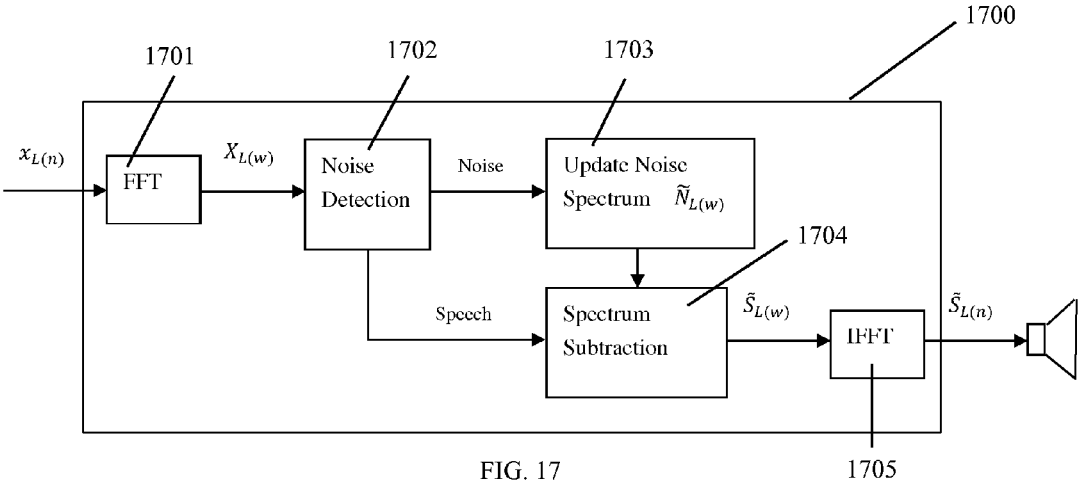
FIG. 17 shows an exemplary structure of a left channel adaptive noise canceller and FIG. 18 shows an exemplary structure of a right channel adaptive noise canceller.
Figure 18:
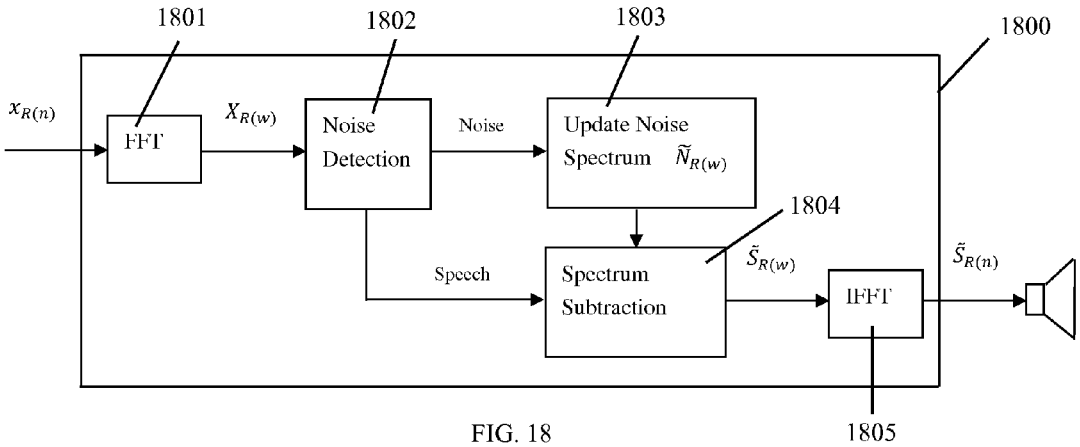

Referring to FIGS. 17 and 18, an exemplary structure of a left channel adaptive noise canceller (ANC) 1700 is shown in FIG. 17 while an exemplary structure of a right channel ANC 1800 is shown in FIG. 18. The structure of the left channel ANC 1700 is the same as that of the right channel ANC 1800.

Now turning to FIG. 17, the left channel ANC 1700 includes a Time-to-Frequency converter 1701 where Fast Fourier Transform (FFT) is performed on an input signal $x_{L(n)}$ in the time domain to convert the input signal into a signal $X_{L(w)}$ in the frequency domain. The frequency-domain signal $X_{L(w)}$ is then fed to a noise detector 1702 for detecting speech and noise. The detected noise is then input to a noise spectrum estimator 1703 for calculating a left channel estimated noise spectrum $\tilde{N}_{L(w)}$. The detected speech and the estimated noise spectrum $\tilde{N}_{L(w)}$ are subsequently fed to a spectrum subtractor 1704 for calculating a left channel estimated clean sound spectrum $\tilde{S}_{L(w)}$. Subsequent to the spectrum subtraction, the estimated clean sound spectrum $\tilde{S}_{L(w)}$ is input to a Frequency-to-Time converter 1705 where IFFT (Inverse Fast Fourier Transform) is performed on the estimated clean sound spectrum $\tilde{S}_{L(w)}$ to convert the input into a left channel estimated clean sound output signal $\tilde{S}_{L(n)}$ in the time domain.

Similar to the left channel ANC 1700, the right channel ANC 1800 includes a Time-to-Frequency converter 1801, a noise detector 1802 which connects the Time-to-Frequency converter 1801, a noise spectrum estimator 1803 which connects the noise detector 1802, a spectrum subtractor 1804 which connects the noise detector 1802 and the noise spectrum estimator 1803, and a Frequency-to-Time converter 1805 which connects the spectrum subtractor 1804.

Related equations and parameters illustrated in FIGS. 17 and 18 are given as follows:

For Left Channel:

$$\text{Estimated Noise Spectrum: } \tilde{N}_{L(w+1)}=\beta_L\tilde{N}_{L(w)}+(1-\beta_L)X_{L(w)} \quad (1)$$

Spectrum Subtraction:

$$|\tilde{S}_{L(w)}|^2=\begin{cases}|X_{L(w)}|^2\cdot\alpha_L|\tilde{N}_{L(w)}|^2\\0\end{cases} \quad (2)$$

$$\measuredangle(\tilde{S}_{L(w)})=\measuredangle(X_{L(w)}) \quad (3)$$

$$\text{Estimated Clean Sound Output: } \tilde{S}_{L(n)}=\text{IFFT}(\tilde{S}_{L(w)}) \quad (4)$$

For Right Channel:

$$\text{Estimated Noise Spectrum: } \tilde{N}_{R(w+1)}=\beta_R\tilde{N}_{R(w)}+(1-\beta_R)X_{R(w)} \quad (5)$$

Figure 19:
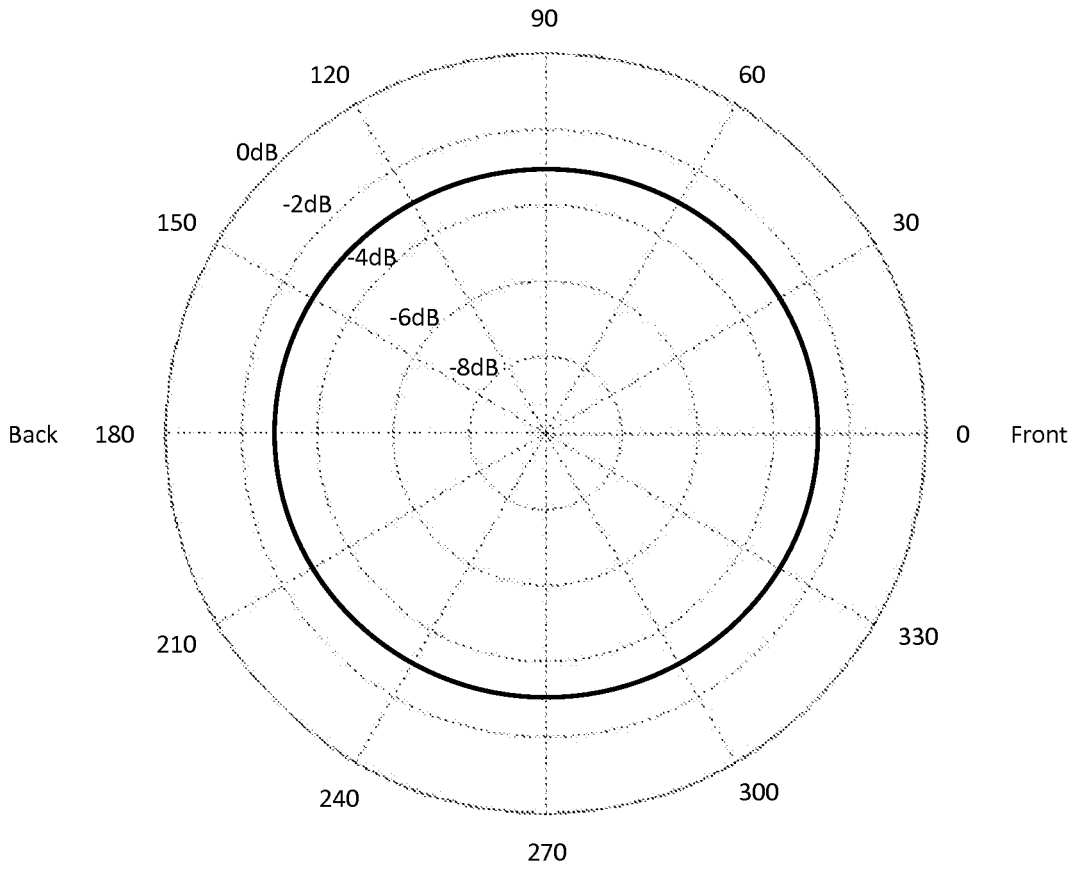
FIG. 19 shows a directional spatial characteristic illustrating the result after the processing in NC mode according to an embodiment of the present application.

Spectrum Subtraction:

$$|\tilde{S}_{R(w)}|^2=\begin{cases}|X_{R(w)}|^2\cdot\alpha_R|\tilde{N}_{R(w)}|^2\\0\end{cases} \quad (6)$$

$$\measuredangle(\tilde{S}_{R(w)})=\measuredangle(X_{R(w)}) \quad (7)$$

$$\text{Estimated Clean Sound Output: } \tilde{S}_{R(n)}=\text{IFFT}(\tilde{S}_{R(w)}) \quad (8)$$

where $x_{L(n)}$: Left Channel Frontend Microphone Signal
$x_{R(n)}$: Right Channel Frontend Microphone Signal
$X_{L(w)}$: Left Channel Spectrum of $x_{L(n)}$ (i.e. FFT($x_{L(n)}$))
$X_{R(w)}$: Right Channel Spectrum of $x_{R(n)}$ (i.e. FFT($x_{R(n)}$))
$|X_{L(w)}|$: Left Channel Magnitude Spectrum
$|X_{R(w)}|$: Right Channel Magnitude Spectrum
$\measuredangle(X_{L(w)})$: Left Channel Phase Spectrum
$\measuredangle(X_{R(w)})$: Right Channel Phase Spectrum
$\tilde{N}_{L(w)}$: Left Channel Estimated Noise Spectrum
$\tilde{N}_{R(w)}$: Right Channel Estimated Noise Spectrum
$\tilde{S}_{L(w)}$: Left Channel Estimated Clean Sound Spectrum
$\tilde{S}_{R(w)}$: Right Channel Estimated Clean Sound Spectrum
$\tilde{S}_{L(n)}$: Left Channel Estimated Clean Sound Output
$\tilde{S}_{R(n)}$: Right Channel Estimated Clean Sound Output
$\beta_L$: Left Channel Noise Spectrum Coefficient
$\beta_R$: Right Channel Noise Spectrum Coefficient
$\alpha_L$: Left Channel Spectral Subtraction Coefficient
$\alpha_R$: Right Channel Spectral Subtraction Coefficient When a user chooses the Noise Cancellation (NC) mode, the input signal will directly go to the left and right channel ANCs 1700 and 1800 for processing. The background noise can be cut with approximately 30-50%. FIG. 19 shows a directional spatial characteristic illustrating the result after the processing in NC mode. In FIG. 19, a black solid circle on approximately −3 dB line is shown, wherein the right hand side is the front direction (0°) and the left hand side is the back direction (180°). The result shows the effect is omni-directional (i.e. 360° direction), which means that the effect on the front direction is the same as that on the back direction.

2) BF Mode without Backend Microphones (Selection 1)

Figure 20:
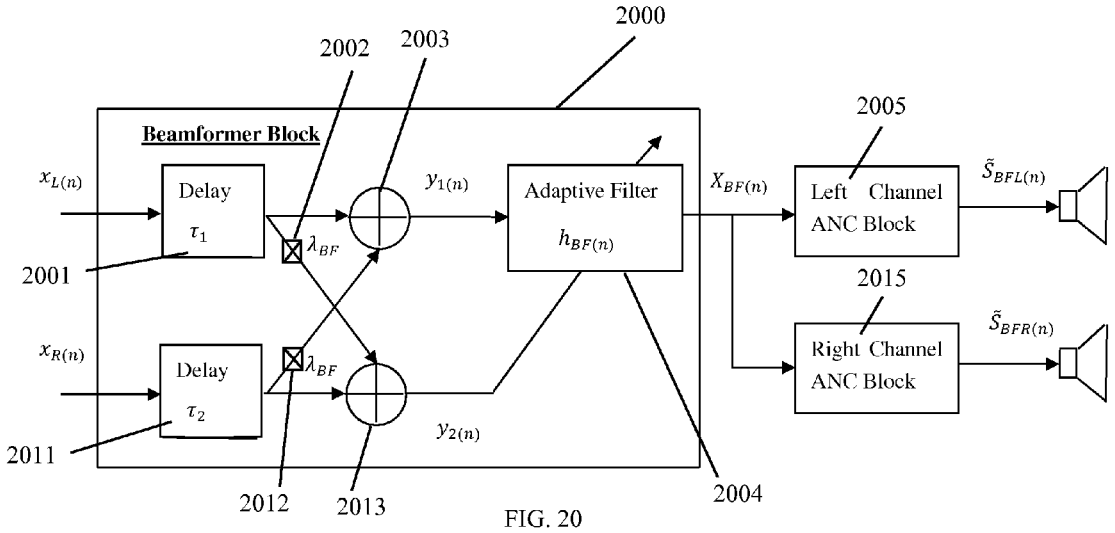
FIG. 20 shows an exemplary structure of a beamformer.

Referring to FIG. 20, a beamformer 2000 includes a left channel delayer 2001, a right channel delayer 2011, a left channel multiplier 2002, a right channel multiplier 2012, a left channel adder 2003, a right channel adder 2013 and an adaptive filter 2004. In this mode, a left channel frontend microphone signal $x_{L(n)}$ is fed to the left channel delayer 2001 where a fixed delay $\tau_1$ is applied to the input signal $x_{L(n)}$. Similarly, a right channel frontend microphone signal $x_{R(n)}$ is fed to the right channel delayer 2011 where a fixed delay $\tau_2$ is applied to the input signal $x_{R(n)}$. Subsequently, for the left channel, the delayed signal $x_{L(n+\tau_1)}$ and a weighted signal $\lambda_{BF}x_{R(n-\tau_2)}$ produced by the multiplier 2012 where the delayed signal $x_{R(n+\tau_2)}$ is given a particular weight $\lambda_{BF}$ are added in the adder 2003 to produce a left channel summed signal $y_{1(n)}$. For the right channel, the delayed signal $x_{R(n+\tau_2)}$ and a weighted signal $\lambda_{BF}x_{L(n+\tau_1)}$ produced by the multiplier 2002 where the delayed signal $x_{L(n+\tau_1)}$ is given a particular weight $\lambda_{BF}$ are added in the adder 2013 to produce a right channel summed signal $y_{2(n)}$. The summed signals and $y_{1(n)}$ and $y_{2(n)}$ are input to the adaptive filter 2004 for adaptive filtering. Consequently, a beamformer sound output signal $X_{BF(n)}$ is obtained after the adaptive filtering.

The beamformer sound output signal $X_{BF(n)}$ produced by the beamformer 2000 is subsequently fed to a left channel ANC 2005 and a right channel ANC 2015 respectively. The structure of the ANC is shown in FIGS. 17 and 18.

Related equations and parameters illustrated in FIG. 20 are given as follows:

$$y_{1(n)}=x_{L(n+\tau_1)}+\lambda_{BF}x_{R(n+\tau_2)} \quad (9)$$

$$y_{2(n)}=\lambda_{BF}x_{L(n+\tau_1)}+x_{R(n+\tau_2)} \quad (10)$$

Adaptive Filter Update:

$$h_{BF(n+1)}=h_{BF(n)}-2\mu X_{BF(n)}y_{2(n)} \quad (11)$$

n represents the $n_{th}$ time slot, n+1 represents the $(n+1)_{th}$ time slot next to the $n_{th}$ time slot; n is positive integer, e.g. 0, 1, 2, . . . .

Beamformer Sound Output:

$$X_{BF(n)}=y_{1(n)}\otimes h_{BF(n)} \quad (12)$$

Left Channel Estimated Clean Sound Output:

$$\tilde{S}_{BFL(n)}=\text{Left Channel ANC of } X_{BF(n)} \quad (13)$$

Right Channel Estimated Clean Sound Output:

$$\tilde{S}_{BFR(n)}=\text{Right Channel ANC of } X_{BF(n)} \quad (14)$$

where $\lambda_{BF}$: Beamforming Coefficient $\mu$: Adaptive Filter Coefficient $\tau_1$ and $\tau_2$: Delay Coefficient In this mode, $\lambda_{BF}=1$. A user can choose the mode via the key pad 1606, for example, when a control key "1" is pressed, the mode is selected correspondingly.

Figure 21:
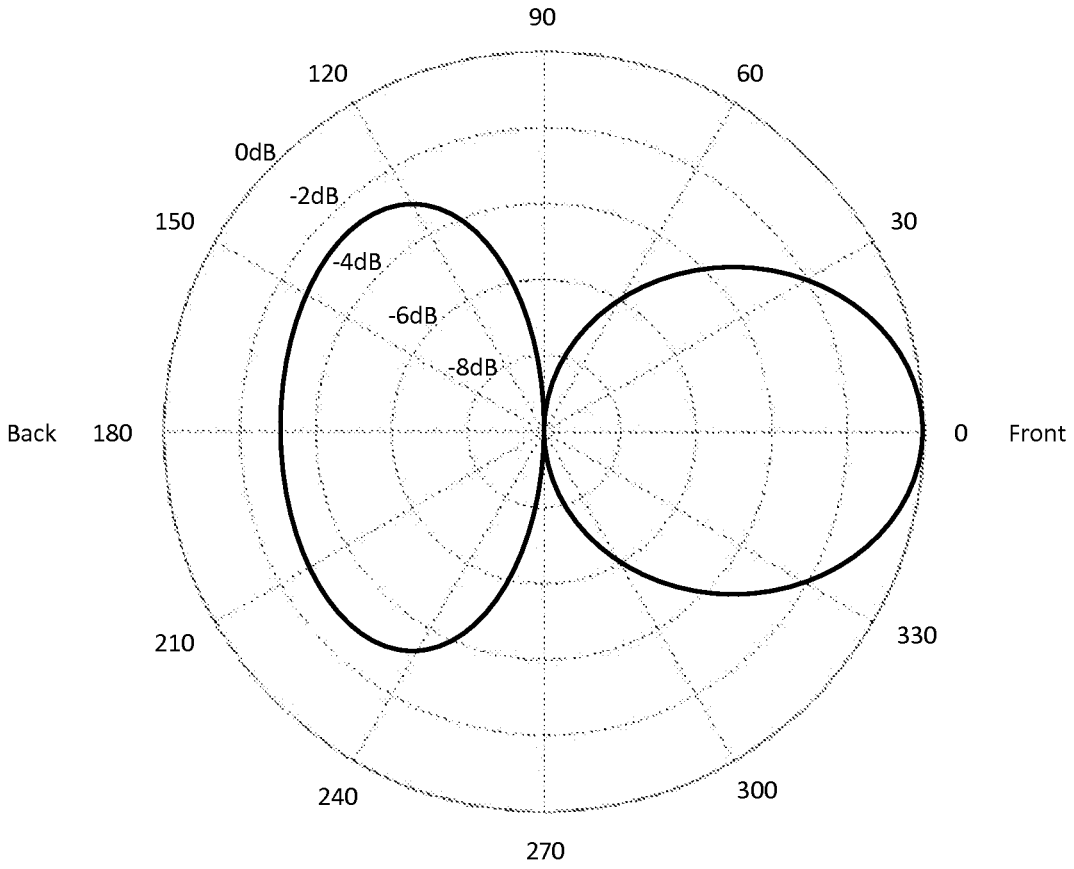
FIG. 21 shows a directional spatial characteristic illustrating the result after the processing in BF mode without backend microphones according to an embodiment of the present application.

When the user chooses the Beamforming (BF) mode without backend microphones, the input signal will be fed to the beamformer 2000 and then the left and right ANCs 2005 and 2015 for processing. As shown in FIG. 21, the background noise can be cut with approximately 30-50%. FIG. 21 shows two separated black solid ellipses, wherein the ellipse on the right hand side is on the direction of approximately 60° while the ellipse on the left hand side is on back direction (180°) and on approximately −3 dB line. The result illustrated in FIG. 21 shows the front has a directional effect of approximately 60°, which is different from that illustrated in FIG. 19.

3) BF Mode with Backend Microphones

Figure 22:
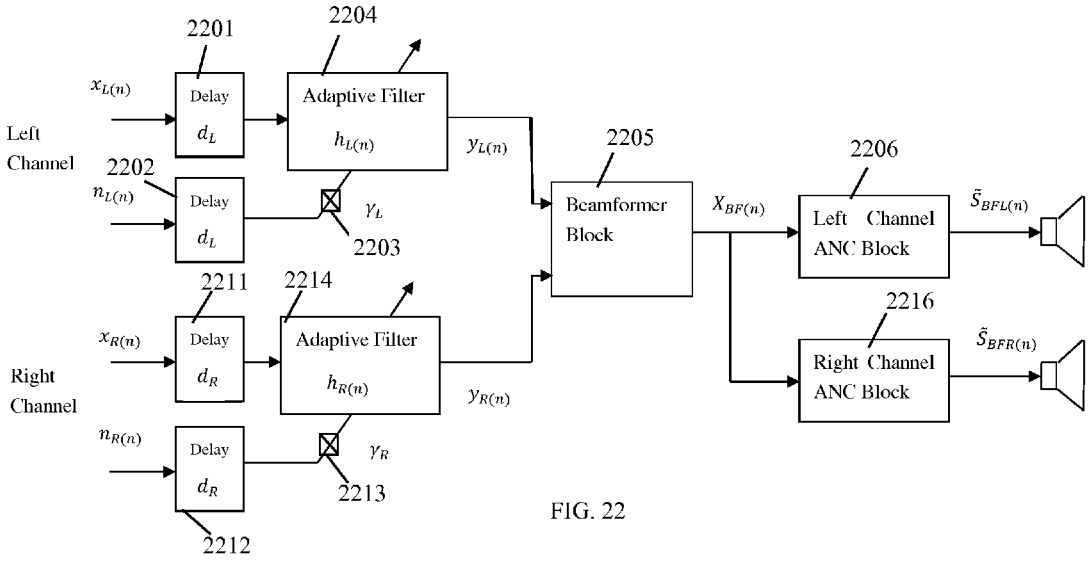
FIG. 22 shows an exemplary structure of the processing system in BF mode with backend microphones according to an embodiment of the present application.

Reference is now made to FIG. 22, for the left channel, a left channel frontend microphone signal $x_{L(n)}$ and a left channel backend microphone signal $n_{L(n)}$ are fed to a delayer 2201 and a delayer 2202 respectively. Further, the delayed left channel backend microphone signal is weighted by a left channel multiplier 2203. The delayed left channel frontend microphone signal and the weighted left channel backend microphone signal are then mixed in an adaptive filter 2204 to produce a left channel filter signal $y_{L(n)}$. In the delayers 2201 and 2202, a fixed delay $d_L$ is set.

Similarly, for the right channel, a right channel frontend microphone signal $x_{R(n)}$ and a right channel backend microphone signal $n_{R(n)}$ are fed to a delayer 2211 and a delayer 2212 respectively. Further, the delayed right channel backend microphone signal is weighted by a right channel multiplier 2213. The delayed right channel frontend microphone signal and the weighted right channel backend microphone signal are then mixed in an adaptive filter 2214 to produce a right channel filter signal $y_{R(n)}$. In the delayer 2211 and 2212, a fixed delay $d_R$ is set.

Subsequent to the adaptive filtering, the left channel filter signal $y_{L(n)}$ and the right channel filter signal $y_{R(n)}$ are input to a beamformer 2205 for beamforming and then input to a left channel ANC 2206 and a right channel ANC 2216 for adaptive noise cancellation respectively. Consequently, a left channel estimated clean sound output signal $\tilde{S}_{BFL(n)}$ from the left channel ANC 2206 is obtained while a right channel estimated clean sound output signal $\tilde{S}_{BFR(n)}$ from the right channel ANC 2216 is obtained.

Related equations and parameters illustrated in FIG. 22 are given as follows:

Left Channel:

$$y_{L(n)}=X_{L(n)}\otimes h_{L(n)} \quad (15)$$

$$\text{Where } h_{L(n+1)}=h_{L(n)}-2\gamma_L\mu_{L(n)}x_{L(n+d_L)}n_{L(n+d_L)} \quad (16)$$

Right Channel:

$$y_{R(n)}=X_{R(n)}\otimes h_{R(n)} \quad (17)$$

$$\text{Where } h_{R(n+1)}=h_{R(n)}-2\gamma_R\mu_{R(n)}x_{R(n+d_R)}n_{R(n+d_R)} \quad (18)$$

where n represents the $n_{th}$ time slot, n+1 represents the $(n+1)_{th}$ time slot next to the $n_{th}$ time slot; n is positive integer, e.g. 0, 1, 2, . . . .

Figure 23:
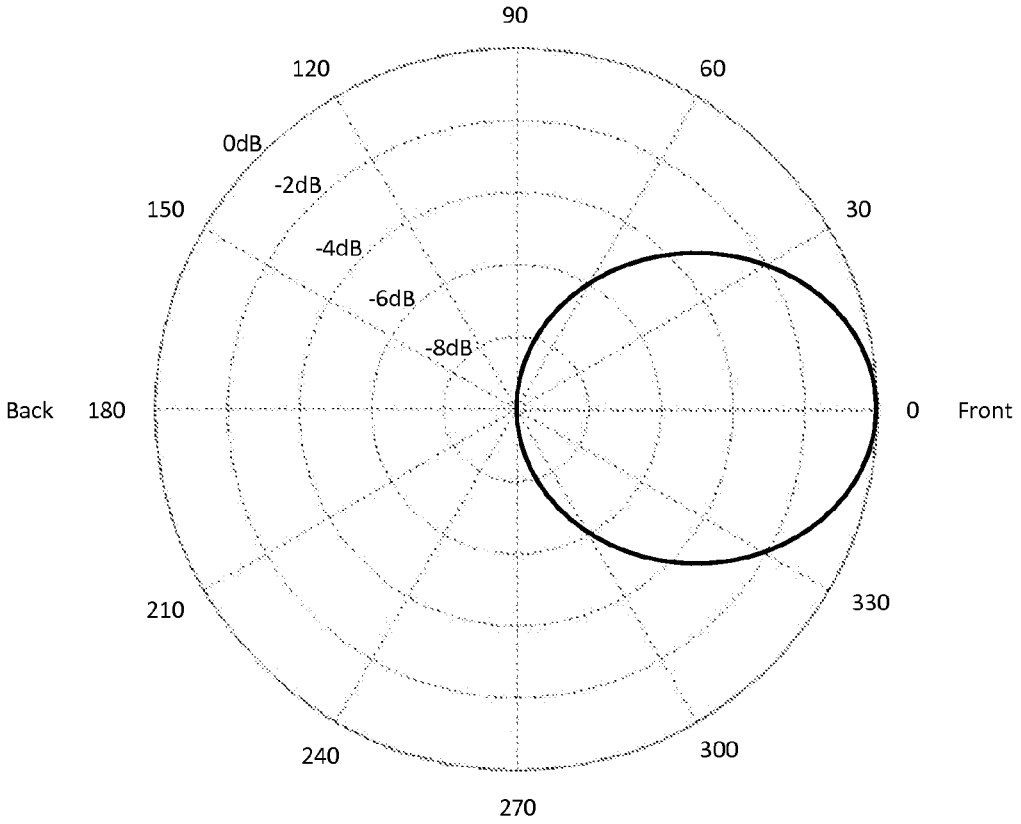
FIGS. 23-25 show directional spatial characteristics illustrating the results after the processing in BF mode with backend microphones under different coefficients.
Figure 24:
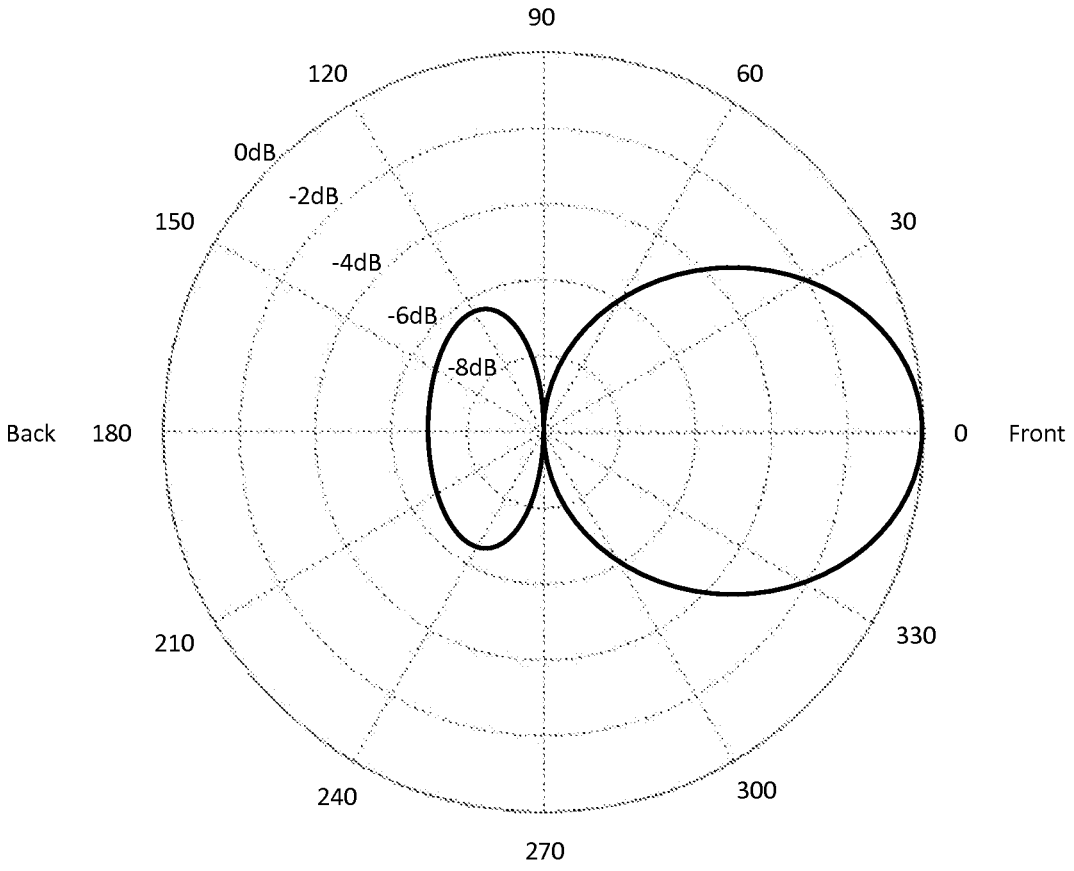
Figure 25:
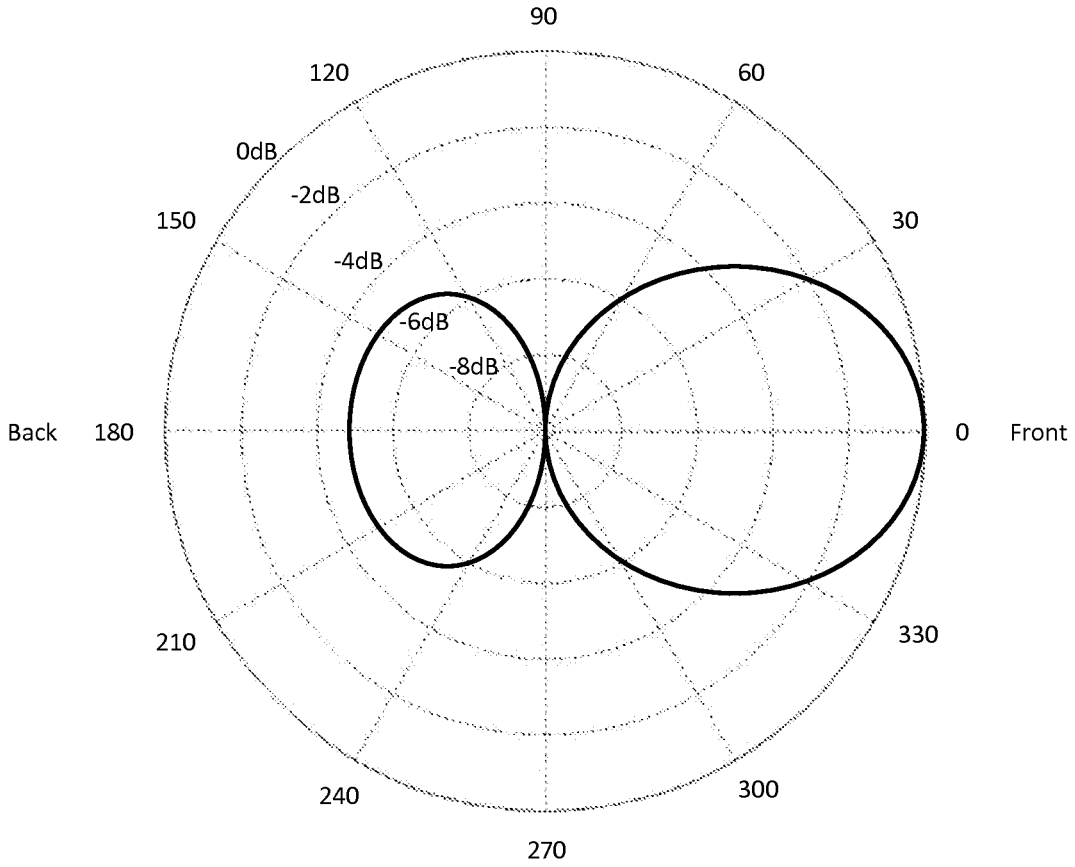

$\gamma_L$: Left Channel Backend Coefficient $\gamma_R$: Right Channel Backend Coefficient $x_{L(n)}$: Left Channel Frontend Microphone Signal $x_{R(n)}$: Right Channel Frontend Microphone Signal $n_{L(n)}$: Left Channel Backend Microphone Signal $n_{R(n)}$: Right Channel Backend Microphone Signal $\lambda_{BF}$: Beamforming Coefficient $\mu_L$: Left Channel Adaptation Coefficient $\mu_R$: Right Channel Adaptation Coefficient $h_{L(n)}$: Left Channel Adaptive Filter $h_{R(n)}$: Right Channel Adaptive Filter $d_L$: Left Channel Delay Coefficient $d_R$: Right Channel Delay Coefficient FIGS. 23-25 show directional spatial characteristics illustrating the result after the processing in BF mode with two backend microphones using different Beamforming Coefficient and different Backend Coefficients.

(1) Selection 2: $\gamma_L$ and $\gamma_R=0.05$, and $\lambda_{BF}=0.5$.

When the user chooses this BF mode (Selection 2), the background noise can be cut with approximately 95-100%. FIG. 23 shows only one black solid ellipse. The right hand side is on the direction of approximately 60°, which is the same as that shown in FIG. 21. The left hand side has nothing, which means that the background noise from the back direction is totally cut.

(2) Selection 3: $\gamma_L$ and $\gamma_R=0.02$, and $\lambda_{BF}=0.7$.

When the user chooses this BF mode (Selection 3), the background noise can be cut with approximately 85-95%. FIG. 24 shows two separated black solid ellipses. The ellipse on the right hand side is on the direction of approximately 60°, which is the same as that shown in FIG. 21. The ellipse on the left hand side is on back direction (180°), and on approximately −7 dB line. That means that the background noise from the back direction is not totally cut. The result illustrated in FIG. 24 shows the front has a directional effect, approximately 60°.

(3) Selection 4: $\gamma_L$ and $\gamma_R=0.01$, and $\lambda_{BF}=1$.

When the user chooses this BF mode (Selection 4), the background noise can be cut with approximately 75-85%. FIG. 25 shows two separated black solid ellipses. The ellipse on the right hand side is on the direction of approximately 60°, which is the same as that shown in FIG. 21. The ellipse on the left hand side is on back direction (180°), and on approximately −5 dB line. That means that the background noise from the back direction is not totally cut. Further, the result of cutting the background noise is worse than that illustrated in FIG. 24. The result illustrated in FIG. 25 shows the front has a directional effect, approximately 60°.

it is understood that any or all of the units: the ANC, the beamformer, the delayer, and the adaptive filter may be implemented in software. Furthermore, some units may be implemented in software, while other units may be implemented in hardware, such as an ASIC. In addition, the delayers 2201, 2202, 2211, 2212, the adaptive filters 2204 and 2214, the beamformer 2205, the left and right channel ANCs 2206 and 2216 illustrated in FIG. 22 may be included in the DSP 1603 illustrated in FIG. 16.

TABLE OF NUMERALS

| | | | | | | | | |
|---|---|---|---|---|---|---|---|---|
| 110 | | | 410 | | 610 | 710 | | Neck-mount portion |
| | 220 | | | | | | | Curved body |
| | | 320 | | | | | | Flexible body |
| | | | | 520 | | | 820 | Flexible cable portion |
| 122 | 222 | | 422 | | 622 | 722 | | First curved arm |
| 124 | 224 | | 424 | | 624 | 724 | | Second curved arm |
| 126 | 226 | 326 | 426 | 526 | 626 | 726 | 826 | Microphone |
| 128 | 228 | 328 | 428 | 528 | 628 | 728 | 828 | casing |
| 132 | 232 | 332 | 432 | 532 | 632 | 732 | 832 | Flexible cable |
| 134 | 234 | 334 | 434 | 534 | 634 | 734 | 834 | portion |
| 136 | 236 | 336 | 436 | 536 | | | | Signal output |
| 138 | 238 | 338 | 438 | 538 | | | | terminal |
| | | | | | 636 | 736 | 836 | Ear phone |
| | | | | | 638 | 738 | 838 | |
| 142 | 242 | 342 | 442 | 542 | 642 | 742 | 842 | Flexible cable |
| 144 | 244 | 344 | 444 | 544 | 644 | 744 | 844 | portion |
| 146 | 246 | 346 | 446 | 546 | 646 | 746 | 846 | Signal connector |
| 152 | 252 | 352 | 452 | 552 | 652 | 752 | 852 | Aperture |
| 154 | 254 | 354 | 454 | 554 | 654 | 754 | 854 | |
| 160 | 260 | 360 | 460 | 560 | 660 | 760 | 860 | Sound processor |

What is claimed is:

1. A hearing aid apparatus for wearing use by a user comprising:

a frontend sound collector configured to collect a frontend signal;

a backend sound collector configured to collect a backend signal; and a sound processor configured to process the frontend signal and the backend signal; wherein the sound processor comprise:

a frontend delayer configured to apply a frontend delay coefficient to the frontend signal to produce a delayed frontend signal;

a backend delayer configured to apply a backend delay coefficient to the backend signal to produce a delayed backend signal;

a multiplier configured to weight the delayed backend signal by a backend coefficient to produce a weighted backend signal; and an adaptive filter configured to process the delayed frontend signal and the weighted backend signal to produce an adaptive filter output signal;

wherein the frontend sound collector comprises a left channel frontend collector configured to collect a left channel frontend signal and a right channel frontend collector configured to collect a right channel frontend signal; and the backend sound collector comprises a left channel backend collector configured to collect a left channel backend signal and a right channel backend collector configured to collect a right channel backend signal;

the frontend delayer comprises a left channel frontend delayer configured to apply a left channel frontend delay coefficient to the left channel frontend signal to produce a delayed left channel frontend signal and a right channel frontend delayer configured to apply a right channel frontend delay coefficient to the right channel frontend signal to produce a delayed right channel frontend signal;

the backend delayer comprises a left channel backend delayer configured to apply a left channel backend delay coefficient to the left channel backend signal to produce a delayed left channel backend signal and a right channel backend delayer configured to apply a right channel backend delay coefficient to the right channel backend signal to produce a delayed right channel backend signal; and the multiplier comprises a left channel multiplier configured to weight the delayed left channel backend signal by a left channel backend coefficient to produce a weighted left channel backend signal and a right channel multiplier configured to weight the delayed right channel backend signal by a right channel backend coefficient to produce a weighted right channel backend signal.

2. A hearing aid apparatus according to claim 1, wherein the adaptive filter comprises a left channel adaptive filter configured to process the delayed left channel frontend signal and the weighted left channel backend signal to produce a left channel adaptive filter output signal and a right channel adaptive filter configured to process the delayed right channel frontend signal and the weighted right channel backend signal to produce a right channel adaptive filter output signal.

3. A hearing aid apparatus according to claim 2, wherein the left channel adaptive filter output signal and the right channel adaptive filter output signal are calculated by following equations:

$$y_{L(n)}=X_{L(n)} \otimes h_{L(n)},$$

where $y_{L(n)}$ is the left channel adaptive filter output signal, and $$h_{L(n+1)}=h_{L(n)}-2\gamma_L\mu_{L(n)}x_{L(n+d_L)}n_{L(n+d_L)};$$

$$y_{R(n)}=X_{R(n)} \otimes h_{R(n)},$$

where $y_{R(n)}$ is the right channel adaptive filter output signal, and $$h_{R(n+1)}=h_{R(n)}-2\gamma_R\mu_{R(n)}x_{R(n+d_R)}n_{R(n+d_R)};$$ where n represents a $n_{th}$ time slot, n+1 represents a $(n+1)_{th}$ time slot next to the $n_{th}$ time slot; n is a positive integer;

$\gamma_L$ is the left channel backend coefficient;

$\gamma_R$ is the right channel backend coefficient;

$x_{L(n)}$ is the left channel frontend signal;

$x_{R(n)}$ is the right channel frontend signal;

$n_{L(n)}$ is the left channel backend signal;

$n_{R(n)}$ is the right channel backend signal;

$\lambda_{BF}$ is a beamforming coefficient;

$\mu_L$ is a left channel adaptation coefficient;

$\mu_R$ is a right channel adaptation coefficient;

$h_{L(n)}$ is a left channel adaptive filter;

$h_{R(n)}$ is a right channel adaptive filter;

$d_L$ is the left channel frontend delay coefficient and the left channel backend delay coefficient; and $d_R$ is the right channel frontend delay coefficient and the right channel backend delay coefficient.

4. A hearing aid apparatus according to claim 2, further comprising:

a beamformer configured to beamforming the left channel adaptive filter output signal and the right channel adaptive filter output signal and output a beamformer sound output signal.

5. A hearing aid apparatus according to claim 4, wherein the beamformer comprises:

a left channel BF delayer configured to apply a left channel BF delay coefficient to the left channel adaptive filter output signal to produce a delayed left channel BF signal;

a right channel BF delayer configured to apply a right channel BF delay coefficient to the right channel adaptive filter output signal to produce a delayed right channel BF signal;

a left channel BF multiplier configured to weight the delayed left channel BF signal by the beamforming coefficient to produce a weighted left channel BF signal;

a right channel BF multiplier configured to weight the delayed right channel BF signal by the beamforming coefficient to produce a weighted right channel BF signal;

a left channel adder configured to add the delayed left channel BF signal and the weighted right channel BF signal to produce a left channel summed signal;

a right channel adder configured to add the weighted left channel BF signal and the delayed right channel BF signal to produce a right channel summed signal; and a BF adaptive filter configured to adaptively filter the left channel summed signal and the right channel summed signal to produce the beamformer sound output signal.

6. A hearing aid apparatus according to claim 5, wherein the beamformer sound output signal is calculated by following equations:

$$X_{BF(n)}=y_{1(n)}\otimes h_{BF(n)},$$

where $X_{BF(n)}$ is the beamformer sound output signal, and $$h_{BR(n+1)}=h_{BF(n)}-2\mu X_{BF(n)}y_{2(n)};$$

$$y_{1(n)}=x_{L(n+\tau_1)}+\lambda_{BF}x_{R(n+\tau_2)}$$

$$y_{2(n)}=\lambda_{BF}x_{L(n+\tau_1)}+x_{R(n+\tau_2)};$$

Where n represents a $n_{th}$ time slot, n+1 represents a $(n+1)_{th}$ time slot next to the $n_{th}$ time slot; n is a positive integer;

$\mu$ is an adaptive filter coefficient;

$\tau_1$ is the left channel BF delay coefficient; and $\tau_2$ is the right channel BF delay coefficient.

7. A hearing aid apparatus according to claim 5, further comprising:

a left channel adaptive noise canceller (ANC) configured to process the beamformer sound output signal and output a left channel estimated clean sound output signal; and a right channel ANC configured to process the beamformer sound output signal and output a right channel estimated clean sound output signal.

8. A hearing aid apparatus according to claim 7, wherein the left and right ANCs each comprise:

a Time-to-Frequency converter configured to convert the beamformer sound output signal into a frequency-domain signal;

a noise detector configured to detect speech and noise from the frequency-domain signal;

a noise spectrum estimator configured to calculate an estimated noise spectrum from the noise;

a spectrum subtractor configured to calculate an estimated clean sound spectrum from the speech and the estimated noise spectrum;

a Frequency-to-Time converter configured to convert the estimated clean sound spectrum into a time-domain estimated clean sound output.

9. A hearing aid apparatus according to claim 8, wherein the left channel estimated clean sound output signal and the right channel estimated clean sound output signal are calculated by following equations:

$$\tilde{N}_{L(w+1)}=\beta_L\tilde{N}_{L(w)}+(1-\beta_L)X_{L(w)},$$

$$|\tilde{S}_{L(w)}|^2=\begin{cases}|X_{L(w)}|^2\cdot\alpha_L|\tilde{N}_{L(w)}|^2\\0\end{cases},$$

$$\angle(\tilde{S}_{L(w)})=\angle(X_{L(w)}),$$

$$\tilde{S}_{L(n)}=IFFT(\tilde{S}_{L(w)}),$$

$$\tilde{N}_{R(w+1)}=\beta_R\tilde{N}_{R(w)}+(1-\beta_R)X_{R(w)},$$

$$|\tilde{S}_{R(w)}|^2=\begin{cases}|X_{R(w)}|^2\cdot\alpha_R|\tilde{N}_{R(w)}|^2\\0\end{cases},$$

$$\angle(\tilde{S}_{R(w)})=\angle(X_{R(w)}),$$

$$\tilde{S}_{R(n)}=IFFT(\tilde{S}_{R(w)}),$$

where $x_{L(n)}$ is the left channel frontend signal, $x_{R(n)}$ is the right channel frontend signal, $X_{L(w)}$ is a left channel spectrum of $x_{L(n)}$, $X_{R(w)}$ is a right channel spectrum of $x_{R(n)}$, $|X_{L(w)}|$ is a left channel magnitude spectrum, $|X_{R(w)}|$ is a right channel magnitude spectrum, $\angle(X_{L(w)})$ is a left channel phase spectrum, $\angle(X_{R(w)})$ is a right channel phase spectrum, $\tilde{N}_{L(w)}$ is a left channel estimated noise spectrum, $\tilde{N}_{R(w)}$ is a right channel estimated noise spectrum, $\tilde{S}_{L(w)}$ is a left channel estimated clean sound spectrum, $\tilde{S}_{R(w)}$ is a right channel estimated clean sound spectrum, $\tilde{S}_{L(n)}$ is the left channel estimated clean sound output, $\tilde{S}_{R(n)}$ is the right channel estimated clean sound output, $\beta_L$ is a left channel noise spectrum coefficient, $\beta_R$ is a right channel noise spectrum coefficient, $\alpha_L$ is a left channel spectral subtraction coefficient, $\alpha_R$ is a right channel spectral subtraction coefficient.

10. A hearing aid apparatus according to claim 8, wherein a Fast Fourier Transform (FFT) is performed in the Time-to-Frequency converter; and an Inverse Fast Fourier Transform (IFFT) is performed in the Frequency-to-Time converter.

11. A hearing aid apparatus according to claim 3, wherein the left channel backend coefficient $\gamma_L$ is equal to 0.05;

the right channel backend coefficient $\gamma_R$ is equal to 0.05; and the beamforming coefficient $\lambda_{BF}$ is equal to 0.5.

12. A hearing aid apparatus according to claim 3, wherein the left channel backend coefficient $\gamma_L$ is equal to 0.02;

the right channel backend coefficient $\gamma_R$ is equal to 0.02; and the beamforming coefficient $\lambda_{BF}$ is equal to 0.7.

13. A hearing aid apparatus according to claim 3, wherein the left channel backend coefficient $\gamma_L$ is equal to 0.01;

the right channel backend coefficient $\gamma_R$ is equal to 0.01; and the beamforming coefficient $\lambda_{BF}$ is equal to 1.

14. A hearing aid apparatus according to claim 1, wherein the sound processor is a Digital Signal Processor (DSP).

15. A hearing aid apparatus according to claim 1, further comprising:

a Bluetooth module and a Radio module as wireless transceivers which connect the sound processor.

16. A hearing aid frontend according to claim 1, wherein the sound processor is configured to select sounds of within ±30 degrees of a forward axis of the user.

17. A hearing aid frontend according to claim 1, wherein a transverse separation distance between the left channel frontend collector and the right channel frontend collector is user adjustable.

18. A hearing aid frontend according to claim 17, wherein the transverse separation distance is set to be between 15 cm to 18 cm.

* * * * *